US010076219B2

(12) United States Patent
Vetse et al.

(10) Patent No.: US 10,076,219 B2
(45) Date of Patent: Sep. 18, 2018

(54) SCRUBBER MACHINE

(71) Applicant: Nilfisk A/S, Brøndby (DK)

(72) Inventors: Kurt Morris Vetse, Maple Grove, MN (US); Kale R. Johnson, Minneapolis, MN (US); Michael Kanitz, Prior Lake, MN (US); Jerome A. Gunn, St. Michael, MN (US)

(73) Assignee: NILFISK A/S, Brondby (DK)

( * ) Notice: Subject to any disclaimer, the term of this patent is extended or adjusted under 35 U.S.C. 154(b) by 292 days.

(21) Appl. No.: 15/173,322

(22) Filed: Jun. 3, 2016

(65) Prior Publication Data

US 2016/0353958 A1 Dec. 8, 2016

Related U.S. Application Data

(60) Provisional application No. 62/171,137, filed on Jun. 4, 2015.

(51) Int. Cl.
*A47L 11/30* (2006.01)
*A47L 11/40* (2006.01)

(52) U.S. Cl.
CPC ..... *A47L 11/305* (2013.01); *A47L 11/4011* (2013.01); *A47L 11/4016* (2013.01); *A47L 11/4038* (2013.01); *A47L 11/4041* (2013.01); *A47L 11/4044* (2013.01); *A47L 11/4055* (2013.01); *A47L 11/4061* (2013.01);
(Continued)

(58) Field of Classification Search
CPC ..... A47L 11/305; A47L 11/4011; A47L 11/4016; A47L 11/4038; A47L 11/4041; A47L 11/4044; A47L 11/4055; A47L 11/4061; A47L 11/4066; A47L 11/4069;
(Continued)

(56) References Cited

U.S. PATENT DOCUMENTS 488,442 A * 12/1892 Merrill ..... A43D 21/12 12/127
3,097,617 A * 7/1963 Abel ..... D05B 39/00 112/470.05
(Continued)

FOREIGN PATENT DOCUMENTS

WO WO 2016/197035 A1 12/2016

OTHER PUBLICATIONS

"International Application Serial No. PCT/US2016/035877, International Search Report dated Nov. 10, 2016", 4 pgs.
(Continued)

*Primary Examiner* — Marc Carlson
(74) *Attorney, Agent, or Firm* — Schwegman Lundberg & Woessner, P.A.

(57) ABSTRACT

A floor scrubber machine can comprise a chassis, a scrub deck and a propulsion system. The scrub deck can include a hands-free, double-scrub side skirt mechanism, and a dual mode side blade assembly. The chassis can include a rear squeegee assembly having a self-aligning hanger system with balanced handles. The propulsion system can include a throttle pedal having a button for forward/reverse control, and a control panel having a setting for rescaling the acceleration profile. A disc brush scrub deck can include a brush centering mechanism. A cylindrical brush scrub deck can include an idler end brush cover with self-aligning tabs, and a self-contained drive mechanism.

20 Claims, 19 Drawing Sheets

(52) U.S. Cl.
CPC ..... *A47L 11/4066* (2013.01); *A47L 11/4069* (2013.01); *A47L 11/4072* (2013.01); *A47L 11/4077* (2013.01); *A47L 11/4083* (2013.01)

(58) Field of Classification Search
CPC ..... A47L 11/4072; A47L 11/4077; A47L 11/4083
See application file for complete search history.

(56) References Cited

U.S. PATENT DOCUMENTS 3,344,455 A * 10/1967 Pauler ..... A47L 11/164 15/180
5,381,648 A * 1/1995 Seegert ..... A01D 34/64 56/15.9
5,615,437 A * 4/1997 Takahashi ..... A47L 11/14 15/319
6,450,867 B1 * 9/2002 Legatt ..... A47L 11/162 451/350
7,640,622 B2 * 1/2010 Vankouwenberg ... A47L 11/201 15/320
2002/0170130 A1 * 11/2002 Shinier ..... A47L 11/16 15/49.1
2005/0235453 A1 * 10/2005 Vankouwenberg ... A47L 11/201 15/340.4
2012/0118319 A1 * 5/2012 Stuchlik ..... A47L 11/293 134/6
2016/0221143 A1 * 8/2016 Dickson ..... B24B 7/186
2016/0296090 A1 * 10/2016 Scott ..... A47L 11/24

OTHER PUBLICATIONS

"International Application Serial No. PCT/US2016/035877, Invitation to Pay Add'l Fees and Partial Search Rpt dated Jul. 28, 2016", 2 pgs.
"International Application Serial No. PCT/US2016/035877, Written Opinion dated Nov. 10, 2016", 7 pgs.
International Application Serial No. PCT/US2016/035877, International Preliminary Report on Patentability dated Dec. 14, 2017, 9 pgs.

* cited by examiner

SCRUBBER MACHINE

CLAIM OF PRIORITY

This patent application claims the benefit of priority of Vetse et al., U.S. Provisional Patent Application No. 62/171,137, entitled "SCRUBBER MACHINE," filed on Jun. 4, 2015, which is hereby incorporated by reference herein in its entirety.

TECHNICAL FIELD

The present application pertains generally, but not by way of limitation, to floor cleaning equipment, such as scrubber machines and self-propelled, ride-on systems having rotary brushes. More particularly, the present application is directed to, but not by way of limitation, various features of a scrubber machine related to improving performance and ease-of-use of the scrubber machine.

BACKGROUND

Industrial and commercial floors are cleaned on a regular basis for aesthetic and sanitary purposes. There are many types of industrial and commercial floors ranging from hard surfaces such as concrete, terrazzo, wood, and the like, which can be found in factories, schools, hospitals, and the like, to softer surfaces such as carpeted floors found in restaurants and offices. Different types of floor cleaning equipment such as scrubbers, sweepers, and extractors, have been developed to properly clean and maintain these different floor surfaces.

A typical scrubber is a walk-behind or drivable, self-propelled, wet-process machine that applies a liquid cleaning solution or fluid from an on-board cleaning solution tank onto the floor through nozzles. Rotating brushes forming part of the scrubber agitate the solution to loosen dirt and grime adhering to the floor. The dirt and grime become suspended in the solution, which is collected by a vacuum squeegee fixed to a rearward portion of the scrubber and deposited into an onboard recovery tank.

OVERVIEW

The present inventors have recognized, among other things, that the user-friendliness of various scrubber machines can be improved over previous systems. For example, the ease of raising and lowering side skirts, changing the tension in side skirts, switching between forward and reverse directions, installing rear squeegee assemblies, and installing of disc-type and roller-type brushes can be improved. In particular, each of these features can be improved to reduce operator effort and time needed to utilize some of these features, thereby improving the ergonomics and performance of the system, among other things.

The subject matter of the present disclosure can help provide solutions to these and other problems, such as by providing a skirt mechanism for a floor scrubber configured to selectively partially guide cleaning fluid alongside a rotary brush of the floor scrubber. The skirt mechanism can comprise: a mount for coupling to a floor scrubber; a first arm rotatably connected to the mount, the first arm having a lever; a second arm rotatably connected to the mount; a blade support rotatably connected to the first and second arms; and a latch connecting the mount and the blade support, the latch including a slot configured to hold the blade support relative to the mount in raised and lowered positions; wherein the slot is shaped such that the lever can be depressed to both raise and lower the blade support to the raised and lowered positions.

In another example solution, a skirt mechanism for a floor scrubber configured to guide cleaning fluid alongside a rotary brush of the floor scrubber can comprise: a mount for coupling to a floor scrubber; a first arm rotatably connected to the mount; a second arm rotatably connected to the mount; a blade support rotatably connected to the first and second arms; a clip pinned to the blade mount at a notched channel; a first spring connecting the first arm to the clip to cause rotation of the first arm; and a second spring connecting the second arm to the blade mount to cause rotation of the second arm.

In another example solution, a floor scrubber machine can comprise: a chassis; a set of wheels connected to the chassis; a motor mounted on the chassis and connected to the set of wheels to provide propulsion for the floor scrubber machine; and a throttle device for controlling the motor, the throttle device comprising: an acceleration pedal comprising: a first end pivotable proximate the chassis to control a speed of the motor; and a second end displaceable relative to the chassis via rotation of the first end; and a button mounted to the acceleration pedal proximate the second end to control forward and backward rotation of the motor.

In another example solution, a squeegee system for a floor scrubber can comprise: an elongate mounting plate for connecting to a floor scrubber, the elongate mounting plate comprising a rear edge and first and second wings disposed at opposite end portions of the rear edge; a frame plate comprising first and second hangers disposed between ends of the frame plate, the first and second hangers configured to engage the first and second wings, respectively; and a wiper blade mounted to the frame plate; wherein first and second engagements between the first wing and the first hanger and the second wing and the second hanger, respectively, define fulcrum points for rotation of the frame plate relative to the elongate mounting point.

In another example solution, a scrub deck assembly for a floor scrubber can comprise: a deck body having an outer surface and an inner surface; a motor mounted to the outer surface of the deck body, the motor having a drive shaft extending through the deck body to the inner surface; first and second ports in the deck body located equidistant from the drive shaft; and a first alignment mechanism comprising: a first bracket mounted to the outer surface of the deck body; first and second arms rotatably extending from the first bracket opposite the outer surface of the deck body; and first and second alignment posts extending from the first and second arms, respectively; wherein the first and second arms locate the first and second alignment posts with the first and second ports, respectively.

In another example solution, an idler end brush cover for a scrubber deck of a floor scrubber can comprise: a cover body comprising: a flat lower edge; an upper portion; and first and second side portions connecting the flat lower edge and the upper portion; first and second angled notch surfaces located in the first and second side portions at opposite ends of the flat lower edge; and first and second tabs extending from the cover body opposite the first and second angled notch surfaces to form first and second channels, respectively, in the first and second side portions.

In another example solution, a self-contained drive mechanism for a floor scrubber can comprise: a housing comprising a first opening and a second opening; a motor coupled to the first opening such that a drive shaft of the motor extends into the housing; an idler shaft disposed in the second opening; a lug coupled to a first end of the idler shaft outside the housing; a first sheave connected to the drive shaft inside the housing; a second sheave connected to the idler shaft inside the housing; and a belt connecting the first sheave and the second sheave.

This overview is intended to provide an overview of subject matter of the present patent application. It is not intended to provide an exclusive or exhaustive explanation of the invention. The detailed description is included to provide further information about the present patent application.

DETAILED DESCRIPTION

Figure 1:
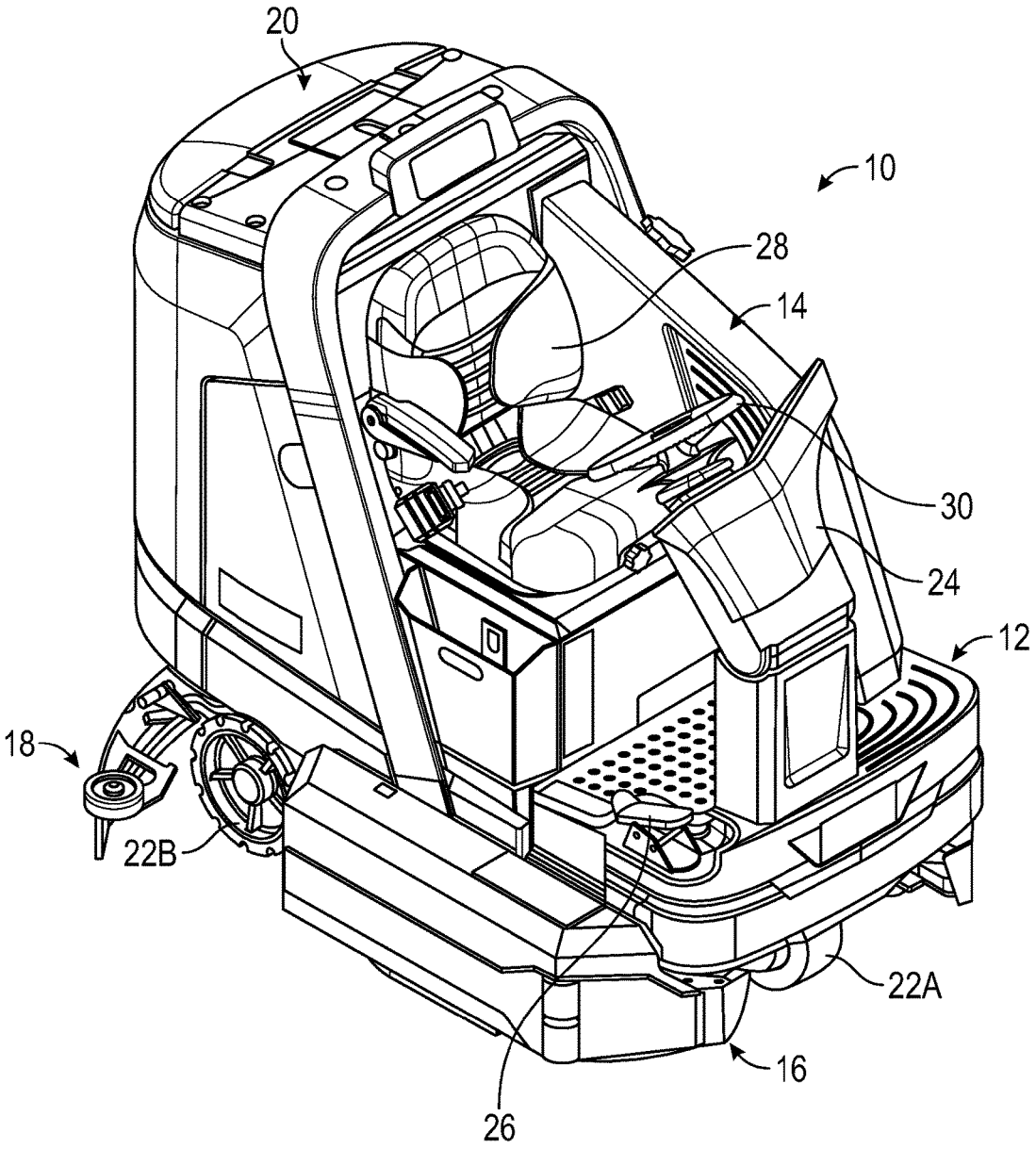
FIG. 1 is a perspective view of a floor cleaning system of the present disclosure.

FIG. 1 is a perspective view of floor cleaning system 10 of the present disclosure. Floor cleaning system, or scrubber machine, 10 can include chassis 12, operator control system 14, scrub system 16, rear squeegee system 18, and recovery system 20.

Chassis 12 can comprise a rigid frame upon which other components and sub-systems of floor cleaning system 10 can be mounted. For example, wheels 22A and 22B can be mounted to chassis 12. Operator control system 14 can be mounted to chassis 12 and connected to wheel 22A to allow for operation of floor cleaning system 10 via steering column 24 and pedal 26. For example, an operator of floor cleaning system 10 can sit in seat 28 in order to control pedal 26 and steering wheel 30 of steering column 24. Steering wheel 30 can control turning of system 10 by controlling the orientation of wheel 22A, while pedal 26 can control movement of system 10 by controlling the rotational speed of wheel 22B. An embodiment of control pedal 26 is described in detail with reference to FIGS. 7A and 7B. In various examples, floor cleaning system 10 can be electrically operated and can include a battery for powering an electric motor that drives wheel 22B and a corresponding opposite wheel (not shown).

Recovery system 20 can include one or more tanks that provide clean water, or some other cleaning solution, to scrub system 16, and store dirty water collected by squeegee system 18, which is described in detail with reference to FIGS. 8A and 8B. Scrub system 16 can comprise drum-type and disc-type scrubbing mechanisms, as shown in FIGS. 2A and 2B, respectively.

Figure 2A:
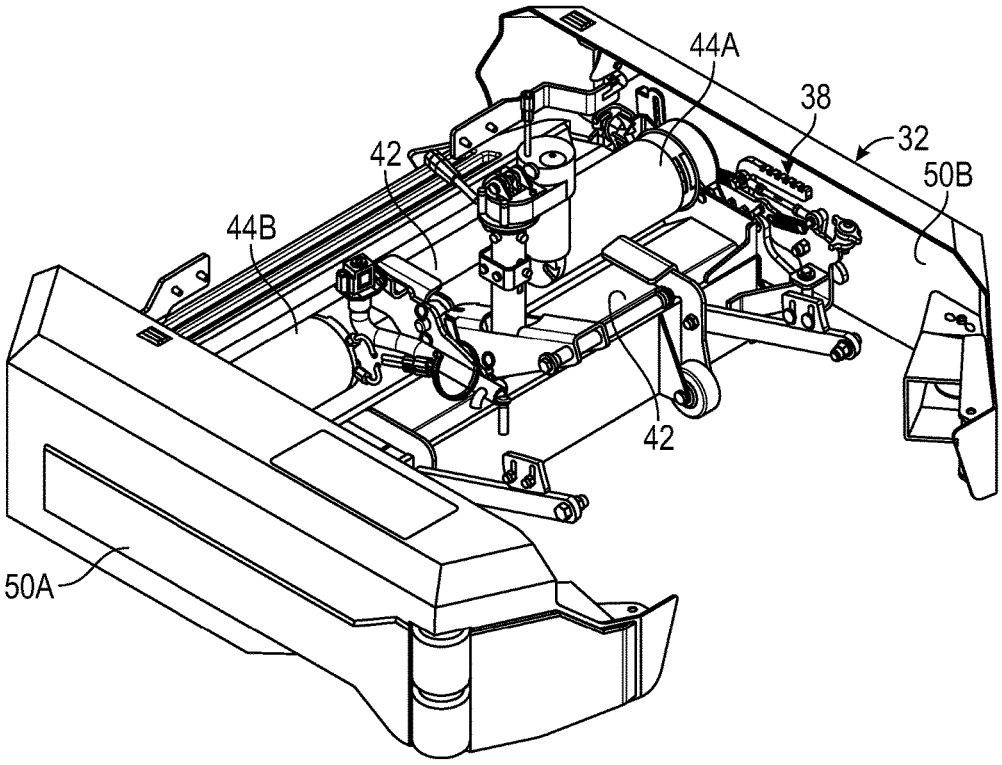
FIGS. 2A and 2B are perspective views of cylindrical and disc scrub systems for the floor cleaning system of FIG. 1, respectively.
Figure 2B:
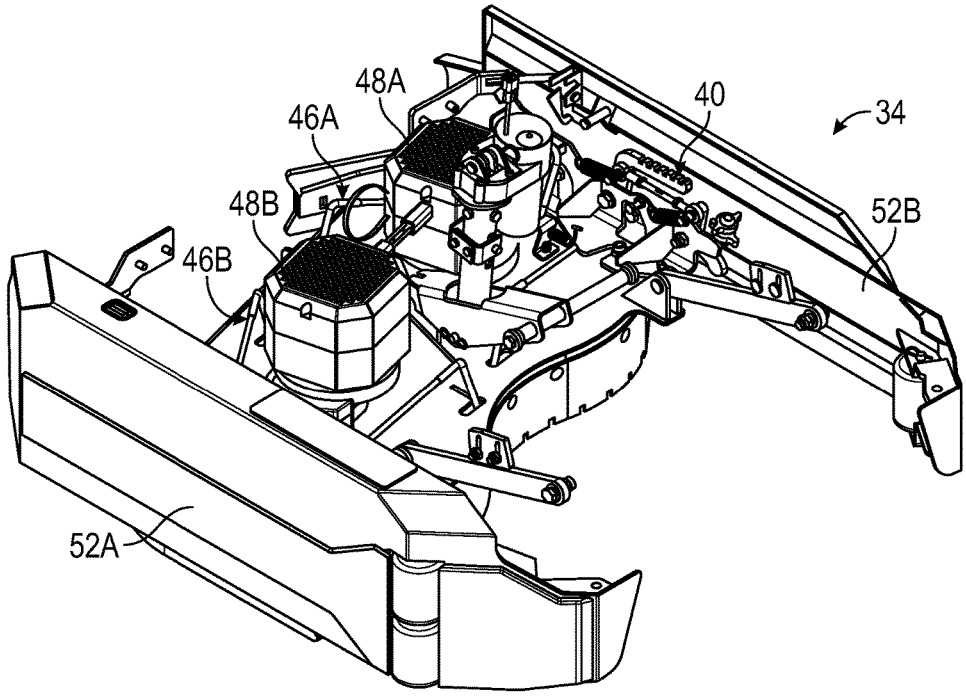

FIGS. 2A and 2B are perspective views of cylindrical scrub system 32 and disc scrub system 34 for floor cleaning system 10 of FIG. 1, respectively. Systems 32 and 34 can be used alternatively with floor cleaning system 10 and can include the same or similar sub-systems, such as the side skirt mechanisms, rear squeegee mechanisms, and forward/reverse throttle pedals described herein. Cylindrical scrub system 32 and disc scrub system 34 can each include a pair of side skirt mechanisms that can be used to selectively direct water or cleaning solution to the brushes of the respective scrub system. For example, cylindrical scrub system 32 can include side skirt mechanism 38 and disc scrub system 34 can include side skirt mechanism 40. Side skirt mechanisms 38 and 40 can operate similarly, but can be constructed differently. A side skirt mechanism 40 is described with reference to FIGS. 4A-6B.

Cylindrical scrub system 32 can include scrub deck 42 in which cylindrical brushes 214A and 214B (FIG. 11) are disposed. The cylindrical brushes can be driven by self-contained drive mechanisms 44A and 44B, respectively, which are discussed in greater detail with reference to FIGS. 13A and 13B. Cylindrical scrub system 32 can also include idler covers 216A and 216B, as discussed with reference to FIGS. 11-12C.

In addition to side skirt mechanisms 40, disc scrub system 34 can also include alignment mechanisms 46A and 46B that can be used to align disc brushes 58A and 58B (FIG. 3B) with drive motors 48A and 48B, respectively, as described with reference to FIGS. 9-10B.

Scrub systems 32 and 34 can include door systems 50A and 50B and 52A and 52B, respectively, which can be used to contain fluid being agitated by the cylindrical and disc brushes.

Figure 3A:
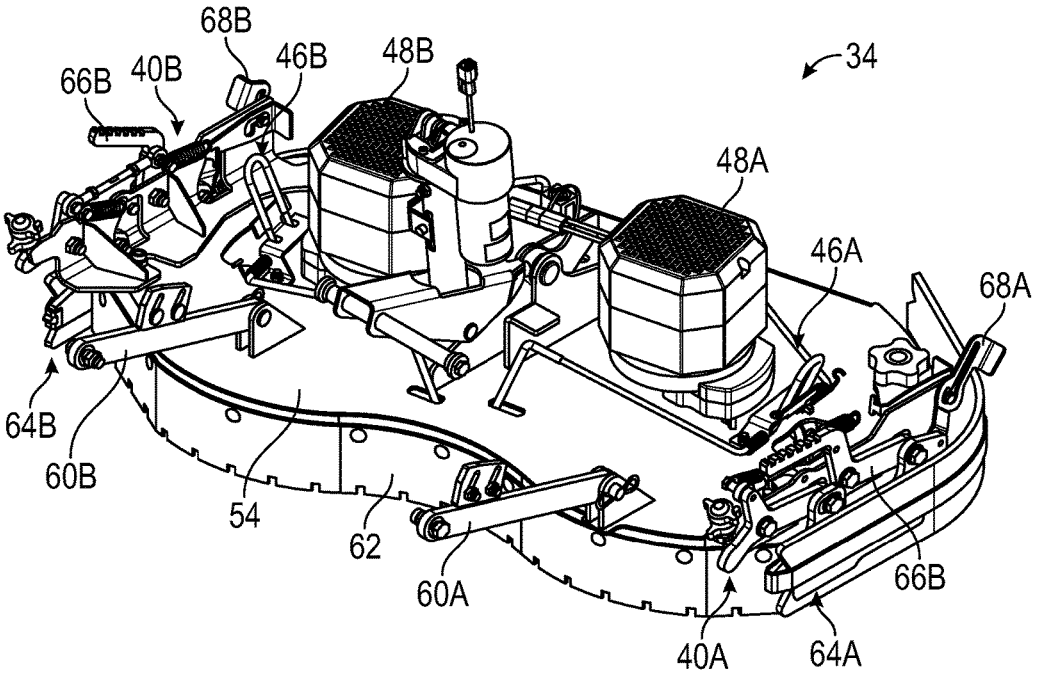
FIG. 3A is a front perspective views of the disc scrub system of FIG. 2B without a door system attached.
Figure 3B:
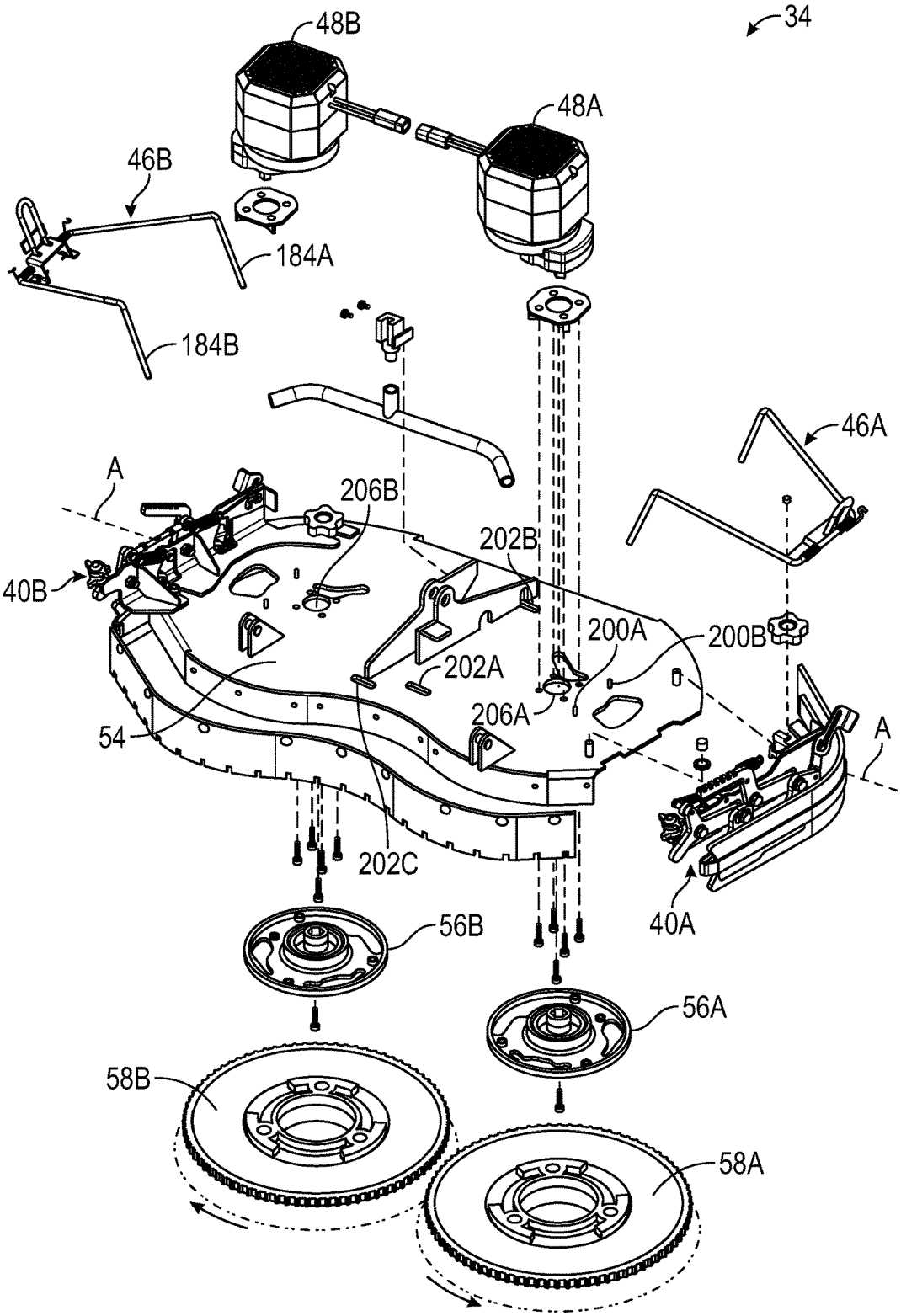
FIG. 3B is an exploded view of the disc scrub system of FIG. 3A showing side skirt mechanisms and brush alignment mechanisms.

FIG. 3A is a front perspective views of disc scrub system 34 of FIG. 2B without door systems 52A and 52B (FIG. 2B) attached. FIG. 3B is a front exploded view of disc scrub system 34 of FIG. 3A showing side skirt mechanisms 40A and 40B and brush alignment mechanisms 46A and 46B. Disc scrub system 34 can include side skirt mechanisms 40A and 40B, alignment mechanisms 46A and 46B and drive motors 48A and 48B, which can be mounted to deck 54. Disc hubs 56A and 56B are connected to drive motors 48A and 48B, respectively, underneath deck 54. Disc brushes 58A and 58B can be connected to disc hubs 56A and 56B.

Deck 54 can be connected to chassis 12 of cleaning system 10 (FIG. 1) using sway arms 60A and 60B. Sway arms 60A and 60B allow disc brushes 58A and 58B to rest on a surface to be cleaned. Front skirt 62 can be attached to deck 54 to contain the cleaning fluid around disc brushes 58A and 58B as cleaning system 10 advances forward. Side skirt mechanism 40A and 40B can include side skirts 64A and 64B, respectively, to selectively contain fluid alongside disc brushes 58A and 58B. Side skirt mechanisms 40A and 40B can be selectively raised and lowered by an operator using levers 66A and 66B, which are discussed in detail with reference to FIGS. 5A and 5B. When in the lowered position, side skirts 40A and 40B can be toggled between soft-floating and stiff-floating configurations using clips 68A and 68B, which are discussed in detail with reference to FIGS. 6A and 6B.

Figure 4A:
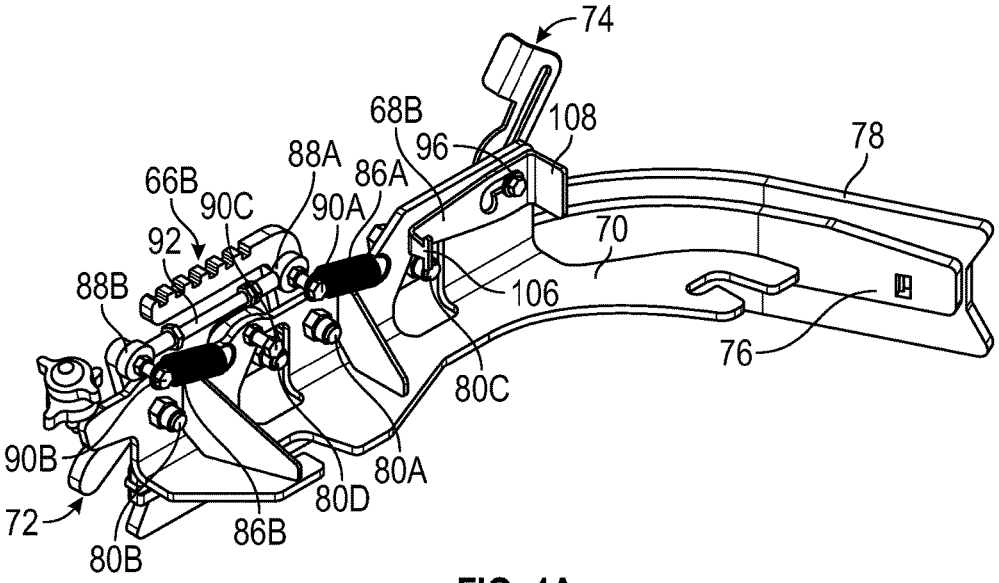
FIGS. 4A and 4B are front and back perspective views of a side skirt mechanism of FIGS. 3A and 3B.
Figure 4B:
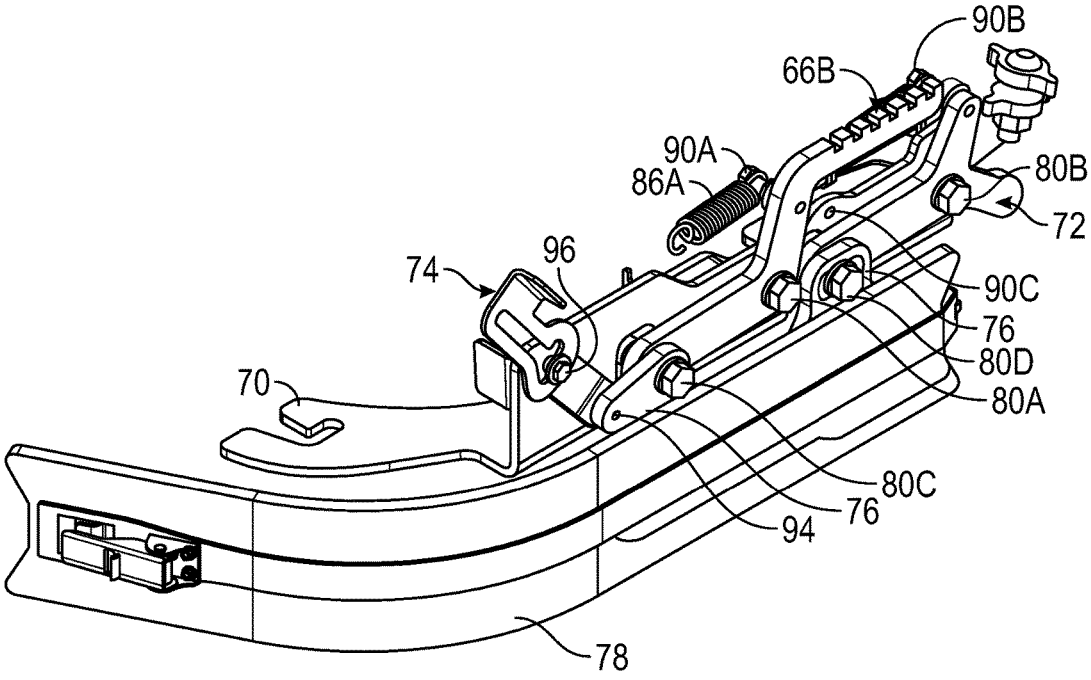
Figure 4C:
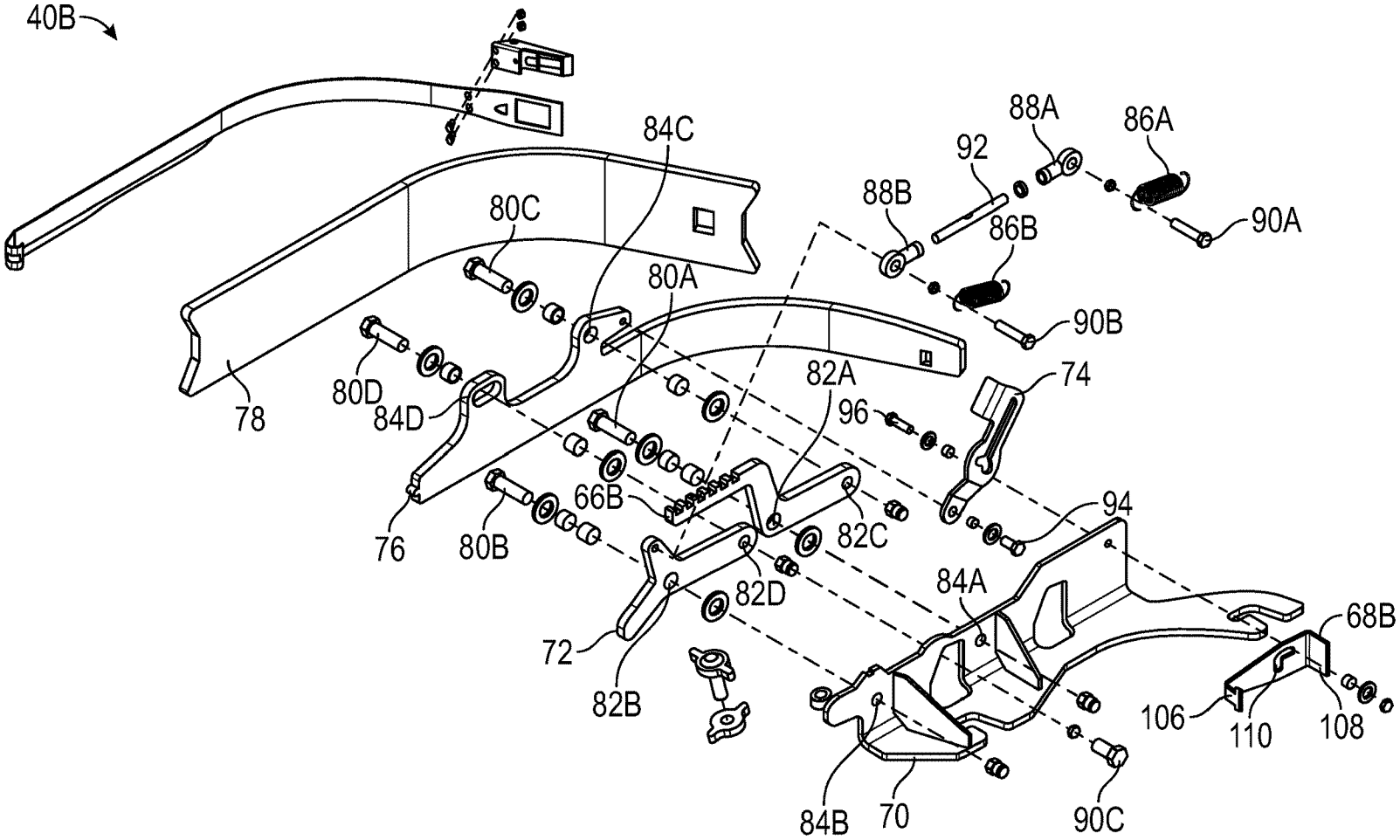
FIG. 4C is an exploded view of the side skirt mechanism of FIGS. 4A and 4B.

FIGS. 4A and 4B are front and back perspective views of side skirt mechanism 40B of FIGS. 3A and 3B. FIG. 4C is an exploded view of side skirt mechanism 40B of FIGS. 4A and 4B. FIGS. 4A-4C are discussed concurrently.

Side skirt mechanism 40B can include lever 66B, clip 68B, mount 70, arm 72, latch 74, blade support 76, and blade 78. Side skirt 64B (FIG. 3A) can include blade support 76 and blade 78. Lever 66B can be rotatably connected to mount 70 via fastener 80A at bores 82A and 84A. Arm 72 can be rotatably connected to mount 70 via fastener 80B at bores 82B and 84B. Lever 66B can be rotatably connected to blade support 76 via fastener 80C at bores 82C and 84C. Arm 72 can be rotatably connected to blade support 76 via fastener 80D at bores 82D and 84D. Spring 86A can be coupled to lever 66B at eyelet 88A at a first end and to mount 70 at clip 68B at a second end using fastener 90A. Spring 86B can be coupled to arm 72 at eyelet 88B at a first end using fastener 90B and to mount 70 at a second end using fastener 90C. Eyelets 88A and 88B can be connected by rod 92. The various pins, fasteners, eyelets and rods described herein can be mounted and/or secured using various nuts, washers, bushings, clips and the like, which are not labeled.

As such, lever 66B and arm 72 provide a pair of linkages that suspend blade support 76 from mount 70. Lever 66B and arm 72 form a parallelogram with blade support 76 and mount 70. As discussed below with reference to FIGS. 5A and 5B, the angles of the parallelogram can be changed by actuating lever 66B to raise or lower blade support 76 relative to mount 70, with latch 74 able to hold blade support 76 in the raised position. Latch 74 can be mounted to blade support 76 via fastener 94 and can engage pin 96 connected to mount 70.

Spring 86B applies a nominal amount of downward force to blade support 76 when blade support 70 is in the lowered position. Furthermore, clip 68B can be used to control the amount of tension applied to spring 86A and consequently the amount of additional downward force applied to blade support 70. Clip 68B can be adjusted to control the amount of force required to elevate blade support 76, e.g., overcome the spring forces, and changed the shape of the parallelogram.

Figure 5A:
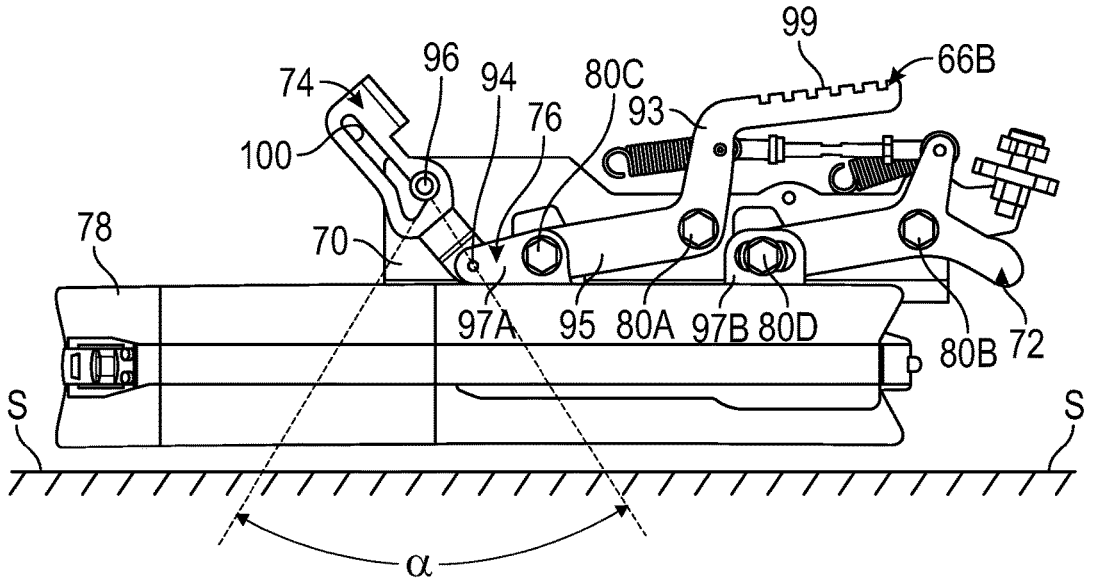
FIG. 5A is a side view of the side skirt mechanism of FIGS. 4A-4C in a raised, double scrub position.
Figure 5B:
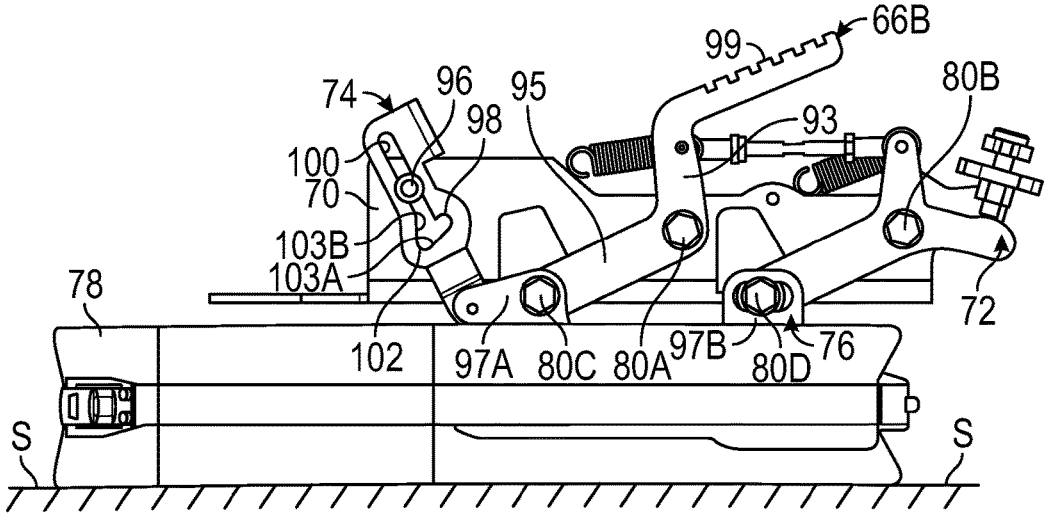
FIG. 5B is a side view of the side skirt mechanism of FIGS. 4A-4C in a lowered, single scrub position.

FIGS. 5A and 5B—Hands Free Double Scrub Side Skirt Mechanism

Double scrubbing a floor surface with a scrubber (walk-behind, or ride-on) is a process where a cleaning solution is applied to the floor while scrubbing and more than one pass is performed over the floor surface without vacuuming up the water with a suction hose attached to a rear squeegee. This allows the cleaning solution to remain in contact with the dirt on the floor for a longer period of time and allows the operator to scrub the same area more than once without re-applying cleaning solution. As such, any side skirt mechanism, typically manually adjustable, are raised to an elevated position. On the final pass over the floor surface to be cleaned the side skirts/blades are manually put back on the machine or lowered into their working position and the rear squeegee is used to vacuum up the dirty cleaning solution. The side blades/skirts are used on scrub decks to contain spray from the scrub brushes while driving generally straight and to squeegee the cleaning solution on the floor into the path of the rear squeegee when the machine makes a turn.

To perform the double scrub operation side skirts/blades are typically either completely removed from the machine or they are manually raised with the operator's hands and manually locked in an "up" position and/or manually disengaged into a "down" position. In these various designs, locking and/or disengaging the side skirt/blade assemblies required the operator to manually engage the skirt/blade assembly by grabbing the dirty, bottom part of the blade with a hand.

The present inventors have recognized that it is more operator friendly to have the double scrub latch (e.g., latch 74) automatically engage when the skirt/blade assembly is lifted (e.g., using lever 66B) and to be able to manually depress the latch or step on lever 66B to disengage the latch.

With reference to FIG. 5A, side skirt mechanism 40B can be positioned and held in an elevated or lifted position such that blade 78 is lifted off of surface S and supported by mount 70. Fasteners 80A and 80B hold lever 66B and arm 72 against mount 70, while fasteners 80C and 80D hold blade support 76 to lever 66B and arm 72 at tabs 97A and 97B, respectively. As such, a parallelogram formed by pins 80A-80D can change shape as blade support 76 is raised and lowered. In the raised position, the parallelogram is flattened as latch 74 holds blade support 76 a fixed distance from support 70. In particular, latch 74 includes notch 98 (FIG. 5B) in slot 100 that can engage pin 96. Slot 100 can extend along a major axis. As shown in FIG. 5B, the parallelogram is expanded as blade 78 rests on surface S and pin 96 is free to move in slot 100.

Upward motion of latch 74, e.g., movement from the position of FIG. 5B to the position of FIG. 5A, can be caused by stepping on or otherwise applying downward force to lever 66B along foot pedal 99. Stepping on foot pedal 99 causes pin 96 to fall into notch 98. As shown, foot pedal 99 can have corrugations to facilitate gripping of footwear or a pedal pad. Foot pedal 99 can be connected first portion 95 via jog 93 so that foot pedal 99 can act as a lever. As such, the weight of blade support 76 can be at least partially supported by engagement of pin 96 against latch 74 at notch 98.

In one example, latch 74 can be manually engaged to release blade support to a lowered position. In particular, tab 101 of latch 74 can be pushed by an operator, e.g., to the right in FIGS. 5A and 5B, to release latch 74. Tab 101 can be engaged either with a hand or foot of the operator.

Additionally, slot 100 can include a geometry that allows pin 96 to disengage notch 98 when lever 66B is used to apply an upward force to latch 74. In particular, depressing foot pedal 99 can cause a momentary upward force to be applied to latch 74. The upward force can cause pin 96 to engage or impact V-notch 102 at angled surface 103A causing latch 74 to rotate forward (to the right in FIGS. 5A and 5B) into a lower, disengaged position at V-notch 102. In the raised position shown in FIG. 5A, an angle $\alpha$ can be formed between surface 103A and the imaginary plane extending through the axis of pin 96 and pivot 94 of latch 74. The relative position of the center of gravity of side skirt mechanism 40B with respect to pivot 94 can allow latch 74 to operate in a desired manner. In an example, angle $\alpha$ for the raised position can be approximately $61\pm10°$. In the raised position of FIG. 5A, for the position of the center of gravity and angle $\alpha$ of surface 103A, the upward force, which passes through the imaginary plane formed through the axis of pin 96 and the pivot 94, on latch 74 can cause latch 74 to rotate forward and disengages latch 74 from pin 96. From this disengaged position, rapid release of lever 66B can cause latch 74 to lower before gravity would rotate latch 74 rearward and re-engage pin 96 with notch 98. This rapid release causes pin 96 to engage slot 100, which can cause blade support 76 to drop to the lowered position as depicted in FIG. 5B where blade 78 engages surface S. If angle $\alpha$ is greater, pin 96 may not or cannot slide on surface 103A and rotate forward. If angle $\alpha$ is much less, a greater amount of travel is needed to disengage pin 96 from notch 98 and to move pin 96 far enough away from notch 98 to allow pin 96 to engage slot 100 when lever 66B is rapidly released. Angle $\alpha$ formed between surfaces 103A and B has to be large enough to allow pin 96 to engage slot 100. Generally speaking, surface 103B is vertical (or greater) when pin 96 is in the corner of V-notch 102.

Figure 6A:
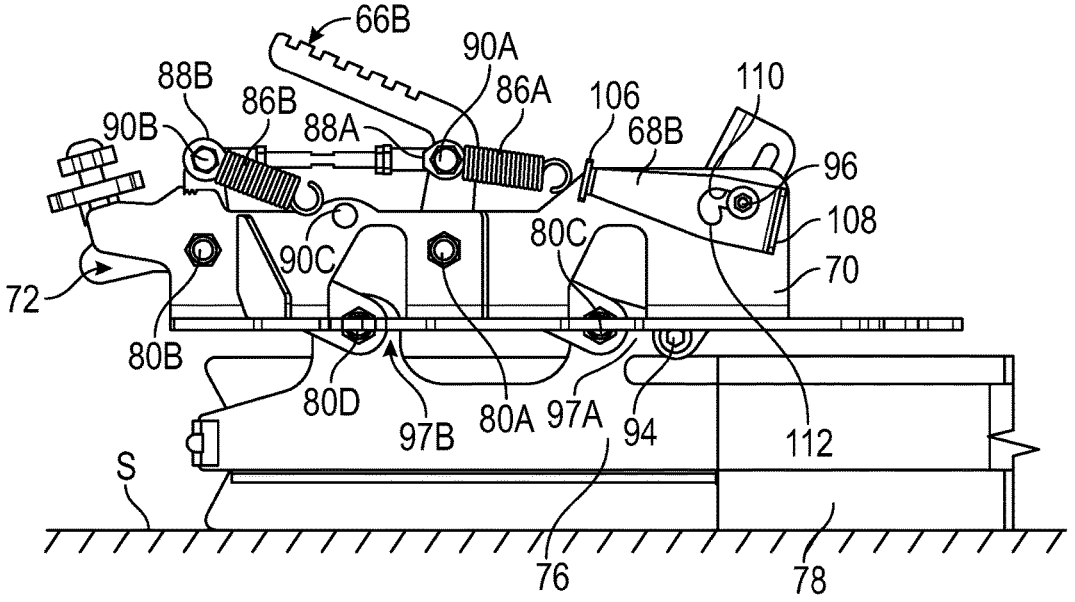
FIG. 6A is a side view of the side skirt mechanism of FIGS. 4A-4C in a soft-floating configuration.
Figure 6B:
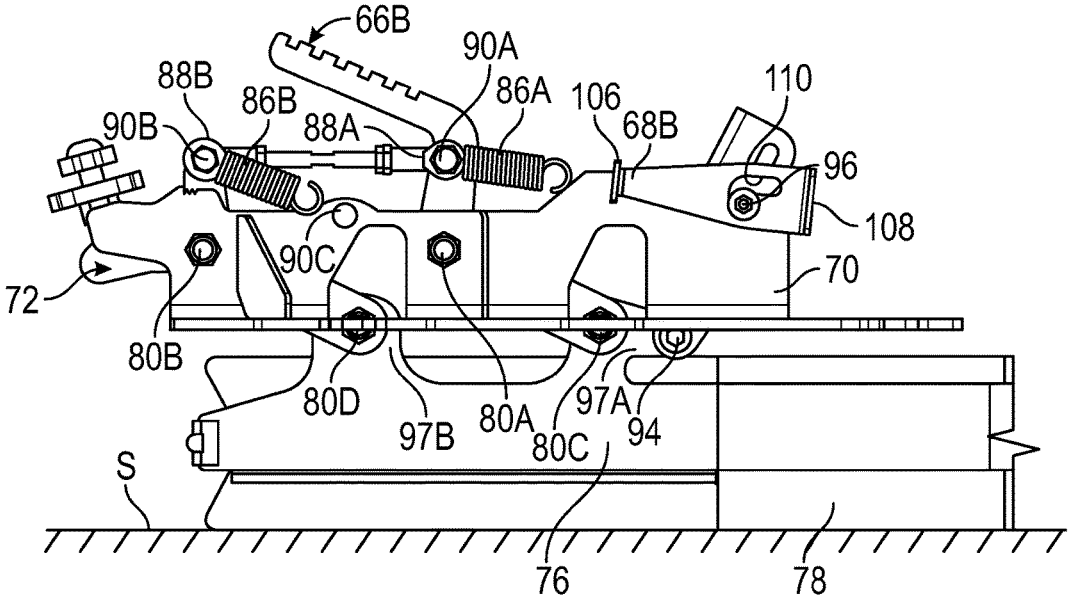
FIG. 6B is a side view of the side skirt mechanism of FIGS. 4A-4C in a stiff-floating configuration.

FIGS. 6A and 6B—Dual Mode Side Blade Assembly

The scrub deck of a ride-on scrubber typically has side blade/skirt assemblies that are used to contain spray from the scrub brushes and to squeegee the cleaning solution on the floor into the path of the rear squeegee when the machine makes a turn. There are two categories of blade/skirt assemblies—fixed and floating.

Fixed blade/skirt assemblies are held in a fixed position relative to the scrub deck. They are inexpensive and can be manually adjusted up and down to account for blade wear, brush wear, and wiping performance. Adjustment of these assemblies is a long, trial and error process of moving the assembly up and down until the desired wiping performance is achieved. Fixed blade/skirt assemblies are typically removed from the machine for double scrubbing.

Floating blade/skirt assemblies allow the blade/skirt to float in a vertical direction relative to the scrub deck. They are generally more expensive because of a four-bar linkage and springs typically used to apply a downward force, but they account for irregularities in floor surfaces and do not need to be adjusted throughout the life of the blade or the scrub brushes. As the brushes or blade/skirt wears down, the springs continue to force the brush or blade/skirt down to maintain wiping performance. Floating skirt assemblies also typically have multiple mounting positions for the springs to increase or decrease the force applied to the wiping blade. Changing the position of the springs can be tedious because the springs have to be removed and the position of the screws has to be changed using tools. These assemblies can also have down stops, which can be adjusted with the use of tools, to prevent the blade from traveling too far downward. Double scrubbing with a floating blade/skirt assembly can be accomplished by either removing the entire assembly, or through the use of a latch.

Referring to FIGS. 6A and 6B, an inner side of mount 70 is shown having lever 66B and arm 72 mounted to an outer side of mount 70 using fasteners 80A and 80B. Lever 66B and arm 72 are attached to blade support 76 using fasteners 80C and 80D. FIGS. 6A and 6B show blade support 76 lowered relative to mount 70 similarly as to what is shown in FIG. 6B. As such, blade 78 can engage surface S.

Spring 86B can be expanded to connect fastener 90B and fastener 90C. As such, spring 86B will tend to cause arm 72 to rotate about fastener 80B (in a clockwise direction relative to the orientation of FIGS. 6A and 6B), thereby causing arm 72 to push down on blade support 76 at fastener 80D. As such, blade 78 will be pushed down to maintain contact with surface S in the event of bumps or wear of the scrub brush being used.

Sometimes it can be desirable to apply additional downward force to blade 78 and to stiffen the resistance of blade support 76 to bumps and other forces. For example, spring 86A can be extended to connect fastener 90A and tab 106 of clip 68B, which is anchored to support 70 via pin 96. Spring 86A will tend to cause lever 66B to rotate about fastener 80A (in a clockwise direction relative to the orientation of FIGS. 6A and 6B), thereby causing lever 66B to push down on blade support 76 at fastener 80C. Linkage 92 can be used to synchronize the forces from springs 86A and 86B.

Clip 68B can be repositioned to provide yet more downward force to blade 78 by further stretching spring 86A using tab 108. Clip 68B includes slot 110 having notch 112. With reference to FIG. 6A, slot 110 extends generally along an axis in the direction of spring 86A and allows clip 68B to be pulled a certain amount in the direction of fastener 90A via the force of spring 86A. Notch 112 can extend from slot 110 and can limit the amount that clip 68B can be pulled toward fastener 90A. Notch 112 can have an arcuate shape so as to grip pin 96. In other words, notch 112 can lengthen the distance between tab 106 and fastener 90A to increase the spring force in spring 86A. As such, lever 66B will be rotated about fastener 80A with a greater force to cause greater downward force at fastener 80C. Tab 108 can be easily grasped by an operator to switch between the soft-floating configuration of FIG. 6A and the stiff-floating configuration of FIG. 6B.

Figure 7A:
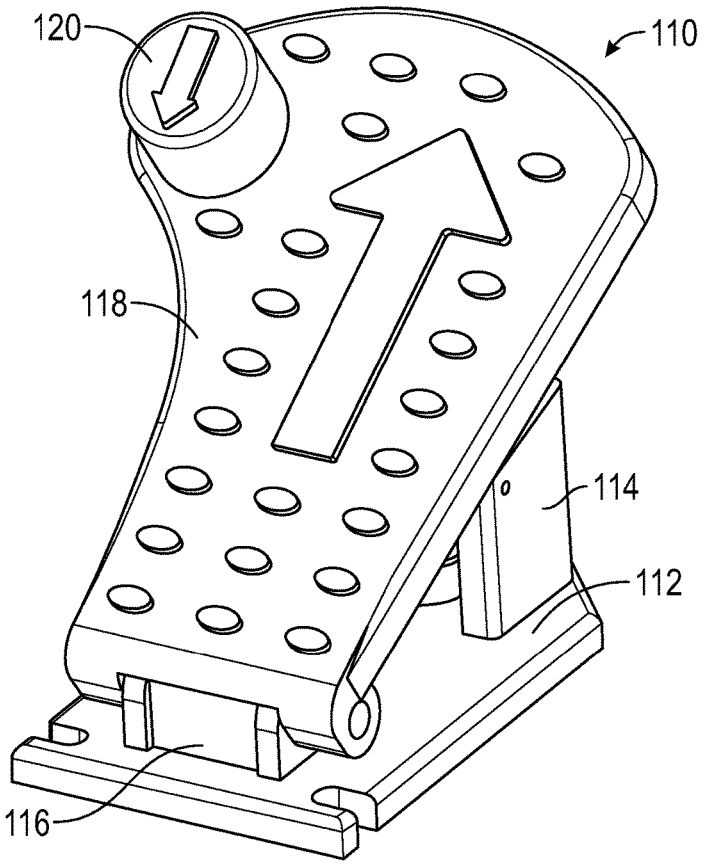
FIG. 7A is a perspective view of a forward/reverse throttle pedal that can be used with the floor cleaning system of in FIG. 1.
Figure 7B:
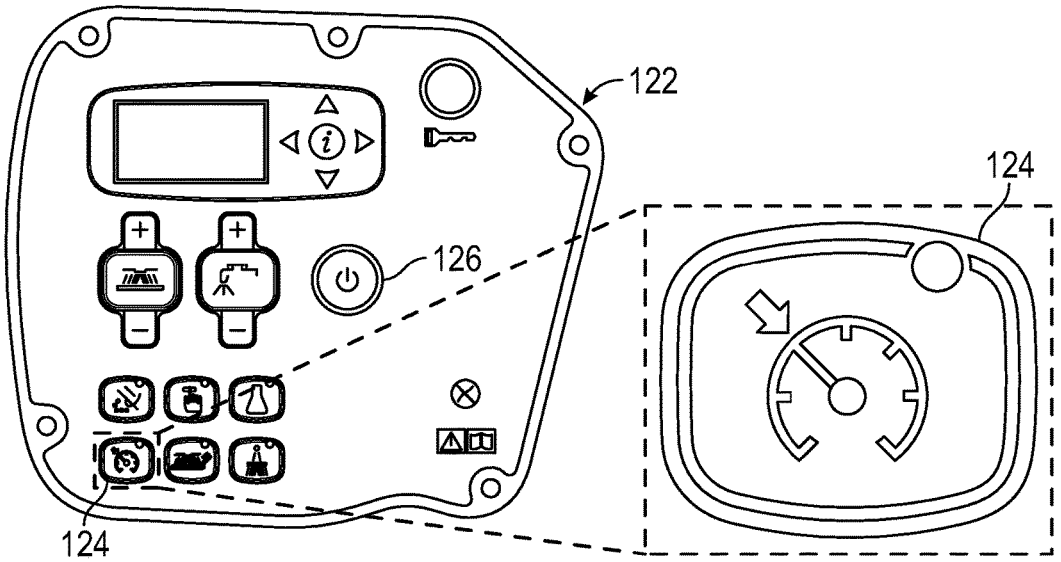
FIG. 7B is a schematic view of a control panel for the forward/reverse throttle pedal of FIG. 7A.
Figure 7C:
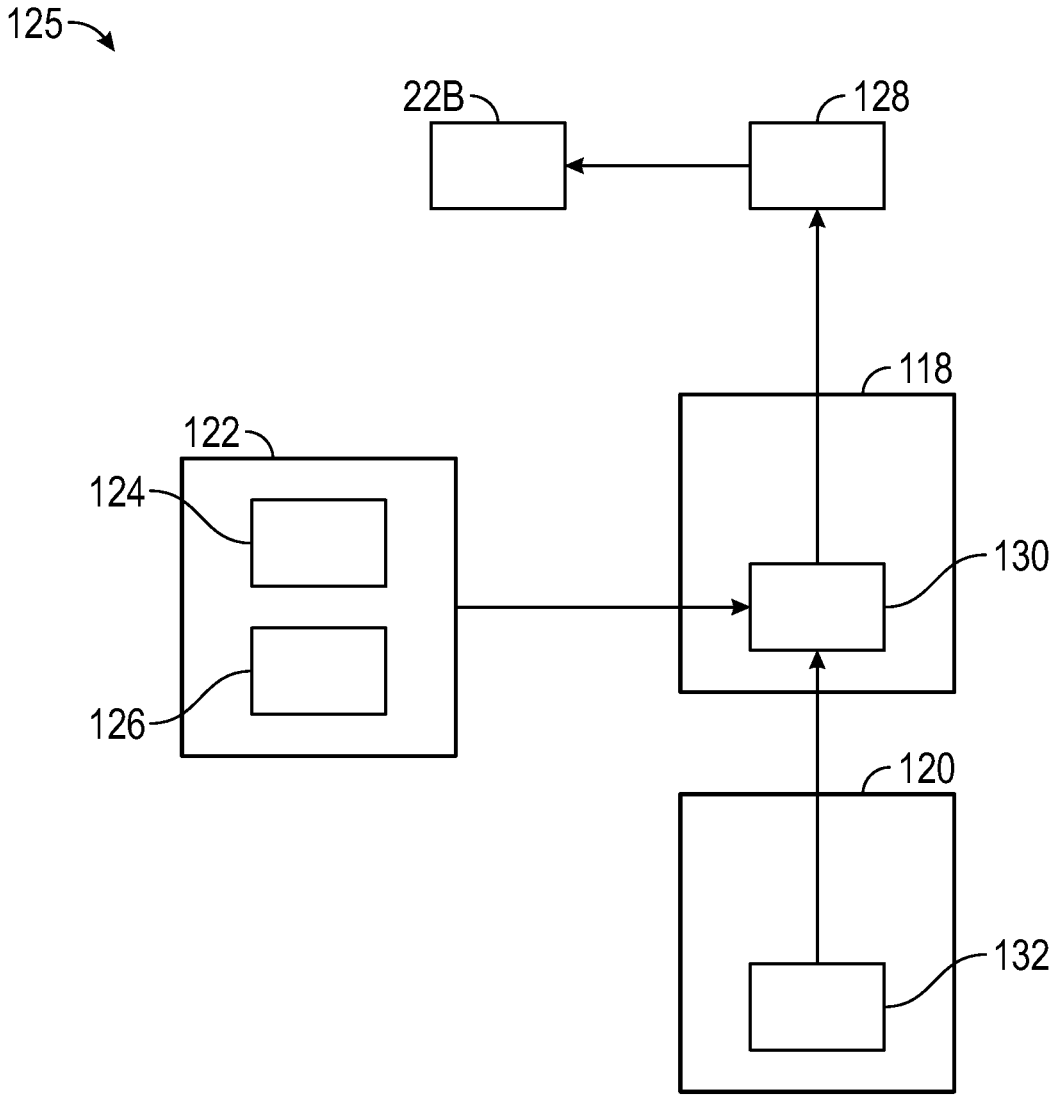
FIG. 7C is a schematic view of a control circuit for the forward/reverse throttle pedal and control panel of FIGS. 7A and 7B.

FIGS. 7A and 7C—Forward/Reverse Throttle Pedal

Speed control for previous floor cleaners utilized a pedal having a single direction of travel. The addition of a secondary control away from the pedal would allow these pedals to control both forward and reverse movement. This is undesirable because it involves coordinated use of two controls. Other speed control pedals feature travel from neutral in two directions. These pedals are commonly referred to as wig-wag pedals. The wig-wag pedals rotate in two directions around an axis parallel to the floor and perpendicular to the side of the user's foot. Forward movement is provided by pressing down on one side of the axis, and reverse movement is provided by pressing down on the other side of the axis. These designs require more space to mount the pedal and are not as ergonomic as a single travel pedal.

The present inventors have recognized the desire for a primary control or pedal that can be depressed from the neutral position, traveling in a single direction or arc while also providing reverse and forward movement control, without the addition of a secondary control located away from the pedal. The secondary control can be located in close proximity to the pedal or on the pedal itself. The output from the primary and secondary devices can be an electrical signal that provides both magnitude and direction.

FIG. 7A is a perspective view of forward/reverse throttle pedal system 110. Pedal system 110 can include base 112, stand 114, pivot assembly 116, pedal 118, and button 120. Base 112 can be mounted to chassis 12 of floor cleaning system 10 (FIG. 1). Stand 114 can include electronic controllers, such as switch 130 (FIG. 7C), that provide control signals to electric motor 128 (FIG. 7C), which can be used with floor cleaning system 10 to provide forward and backward propulsion using wheels 22A and 22B (FIG. 1). As such, pushing down on pedal 118 to cause rotation at pivot assembly 116 toward base 112 can cause forward propulsion or acceleration, with the magnitude of the propulsion being determined by the amount pedal 118 is advanced toward base 112. As such, switch 130 within stand 114 can control the magnitude of propulsion, while switch 132 (FIG. 7C) connected to button 120 can control the direction of propulsion. For example, while button 120 is not depressed or not actuated, pedal 118 can cause forward propulsion to be generated. If button 120 is simultaneously depressed while pedal 118 is depressed, switch 132 connected to button 120 can reverse the direction of propulsion from forward to backward propulsion. In an example, switch 132 connected to button 120 can only reverse the propulsion direction if button 120 is depressed while pedal 118 is in a neutral position, e.g. all the way retracted from base 112, such as by a spring mechanism in pivot assembly 116, so that no propulsion signal is being generated by switch 130 in stand 114. For example, if button 120 is depressed while moving forward, electronics of control panel 122 can take no action. In another example, if button 120 is depressed while moving forward, electronics of control panel 122 can be configured to cause floor cleaning system 10 to decelerate at a faster rate as compared to when button 120 is not depressed. In order to transition to reverse, however, control panel 122 can be configured to require floor cleaning system to first be at a stop, and button 120 depressed.

As such, button 120 can be configured to be depressed before pedal 118 is depressed. This control allows a single motion to be used to for both forward and reverse movement. For example, a foot with the heel resting near base 112 and pivot assembly 116 can be rotated at the ankle straight down to depress pedal 118 to cause forward propulsion. After pedal 118 has been fully returned to the retracted position, the foot can be rotated counterclockwise at the ankle (relative to FIG. 7A), still with the heel resting in the same position, so that the foot can cover and initially depress button 120 before engaging and depressing pedal 118. Thus, the operator can ergonomically produce forward and backward propulsion without having to contort the body or produce awkward ankle movements. Specifically, pedal 118 can only travel in the natural direction of the operator's ankle. It does not require the user to push down with his or her heel, so it allows pedal 118 to be mounted further away from seat 28 (FIG. 1). This can allow better access when stepping on or off floor cleaning system 10.

FIGS. 7B and 7C—Pedal Speed Limiter Control

FIG. 7B is a schematic view of control panel 122 for forward/reverse throttle pedal system 110 of FIG. 7A. Control panel 122 can include various buttons, inputs and outputs for the control of floor cleaning system 10. In particular, control panel 122 can include button 124 that can be depressed to alter the performance characteristics of pedal system 110 of FIG. 7A.

An operator of floor cleaning system 10 can set the maximum speed that will occur when pedal 118 is in a fully depressed pedal position. Initially the fully depressed position of the pedal will result in the maximum allowed speed for floor cleaning system 10, for example, as can be determined by motor 128 (FIG. 7C). A reduced speed for the fully depressed position can be set by driving at a desired speed, i.e. depressing pedal 118 a distance from the not depressed or resting position, and then pressing button 124 on control panel 120. After button 124 is pressed, continuing to depress pedal 118 completely to the fully depressed position will only result in the speed at which point button 124 was depressed and no additional speed will be gained by further depressing pedal 118. Likewise, if pedal 118 is released to the resting position and subsequently depressed to the fully depressed pedal position, floor cleaning system 10 will only move at the selected reduced maximum speed. The travel speed including the reduced maximum speed can be rescaled to the full range of motion of pedal 118 after pedal 118 is released. The selected reduced maximum speed can be correlated to the fully depressed position of pedal 118, with reduced speeds being linearly distributed between the fully depressed and rest positions of pedal 118. This allows the full range of pedal 118 to be utilized while only allowing the reduced maximum speed.

This function allows the operator to fully rest his or her foot on pedal 118 instead of requiring the operator to depress pedal 118 partially. This can reduce operator fatigue and provide a more ergonomic operating position. The reduced speed can be canceled by pressing button 124 again, or turning off the floor cleaning system 10 and turning it back on. This can provide some of the same benefits as cruise control.

FIG. 7C is a schematic view of control circuit 125 for forward/reverse throttle pedal 118 and control panel 122 of FIGS. 7A and 7B. Pedal 118 can include switch 130 for controlling the speed of floor cleaning system 10. Pedal 118 can be configured to mechanically actuate switch 130 as described above. Button 120 can include switch 132 for determining the direction of floor cleaning system 10, e.g., forward or backward movement. Pedal 118 can be configured to mechanically actuate switch 130 as described above. Motor 128 can be connected to wheel 22B and a corresponding coaxial opposite wheel (not shown) via a suitable gear and shaft system to provide propulsion to floor cleaning system 10.

Control panel 122 can be connected to switch 130 to exert electronic control over switch 130, as described with reference to FIG. 7B. Control panel 122 can include various buttons for controlling motor 128, switch 130, and switch 132, as well as other functions of floor cleaning system 10. For example, control panel 122 can include button 124 for controlling the maximum output of switch 130, and power button 126 for controlling power supply to all of the systems of floor cleaning system 10 including motor 128, switch 130, and switch 132.

In an example, with power switch 126 activated to provide power to circuit 125, pedal 118 can be depressed to allow power, such as from a battery, to be connected to motor 128 in a first polarity to cause forward rotation of wheel 22B. Pedal 118 can be depressed over a range of motion that corresponds to a forward speed of zero all the way up to a default maximum speed when pedal 118 is fully depressed, such as when pedal 118 contacts stand 114.

As described above, button 124 can be depressed to set a selected maximum speed to a percentage of the default maximum speed that can be less than one-hundred-percent. This can be accomplished by providing circuit 125 with a voltage limiter that prevents or limits switch 130 from providing the full power available from the battery to motor 128, or any other suitable configuration. The selected maximum speed can be reset by using button 124 again or can be cleared by pressing button 126 and cutting power to control panel 122.

The direction of movement of floor cleaning system 10 can be changed by pressing button 120 and activating switch 132. In an example, this can be accomplished only with pedal 118 in the fully retraced position such that switch 130 is not activated. Activation of switch 132 can cause switch 130 to provide power to motor 128 with the opposite polarity as for the forward direction so as to cause reverse rotation of wheel 22B. Switch 132 of button 120 can be a pressure sensor, a photo switch, a double pull switch or a proximity switch in various examples. Switch 132 can be configured so as to be fully depressed before pedal 118 begins to be depressed. That is, when a foot contacts button 120, the resistance of button 120 can be less than that of pedal 118 such that button 120 can be fully depressed and pedal 118 will only begin to be depressed when button 120 is fully depressed and the foot fully contacts pedal 118. This can help ensure that the change in propulsion direction will always occur when desired because to avoid unintended movements. As mentioned, control panel 122 can be configured to not allow switch 132 to operate or deactivate switch 132 if pedal 118 is partially depressed and/or switch 130 is activated.

Figure 8A:
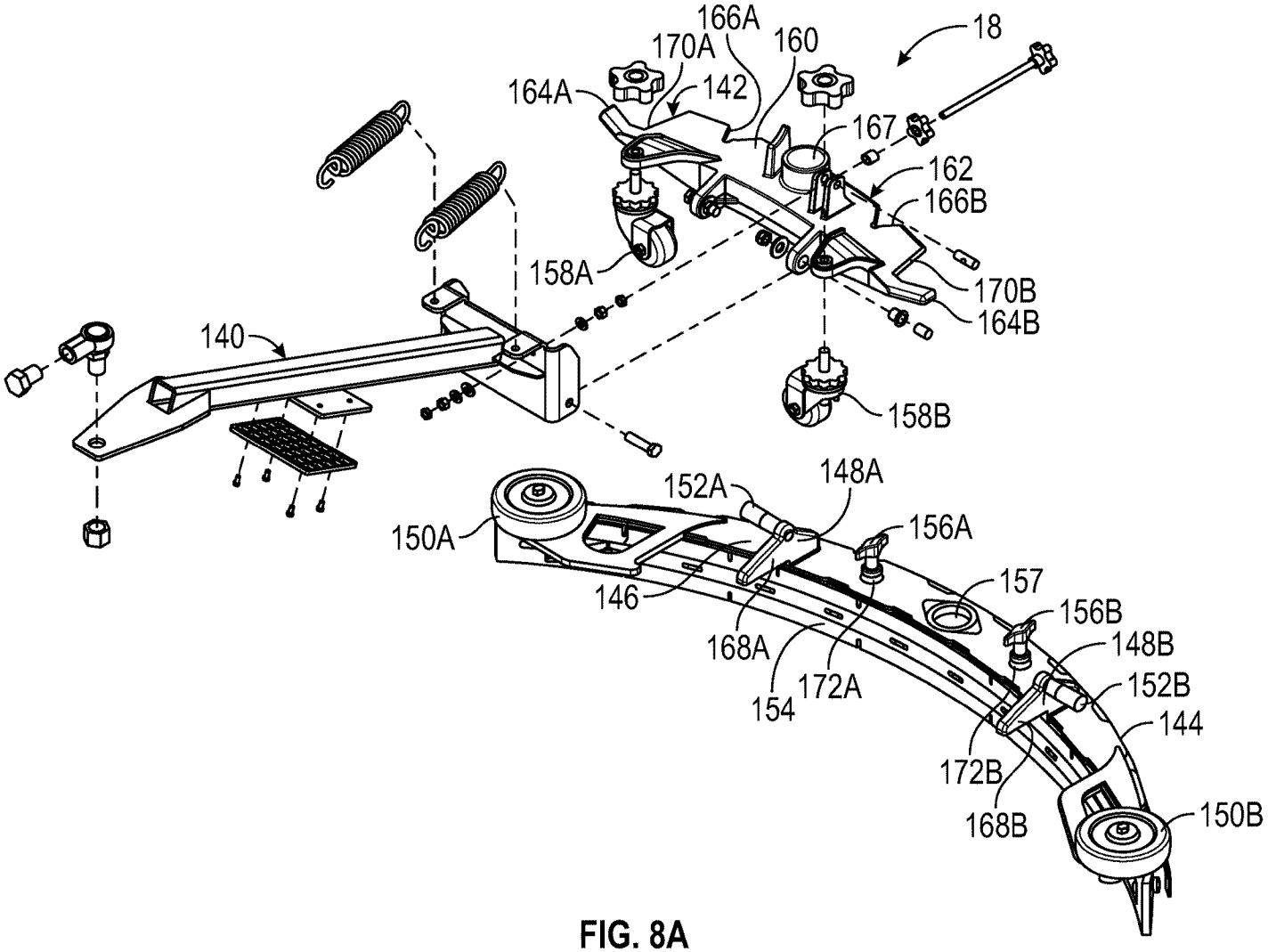
FIG. 8A is an exploded view of a rear squeegee guide system shown in FIG. 1.
Figure 8B:
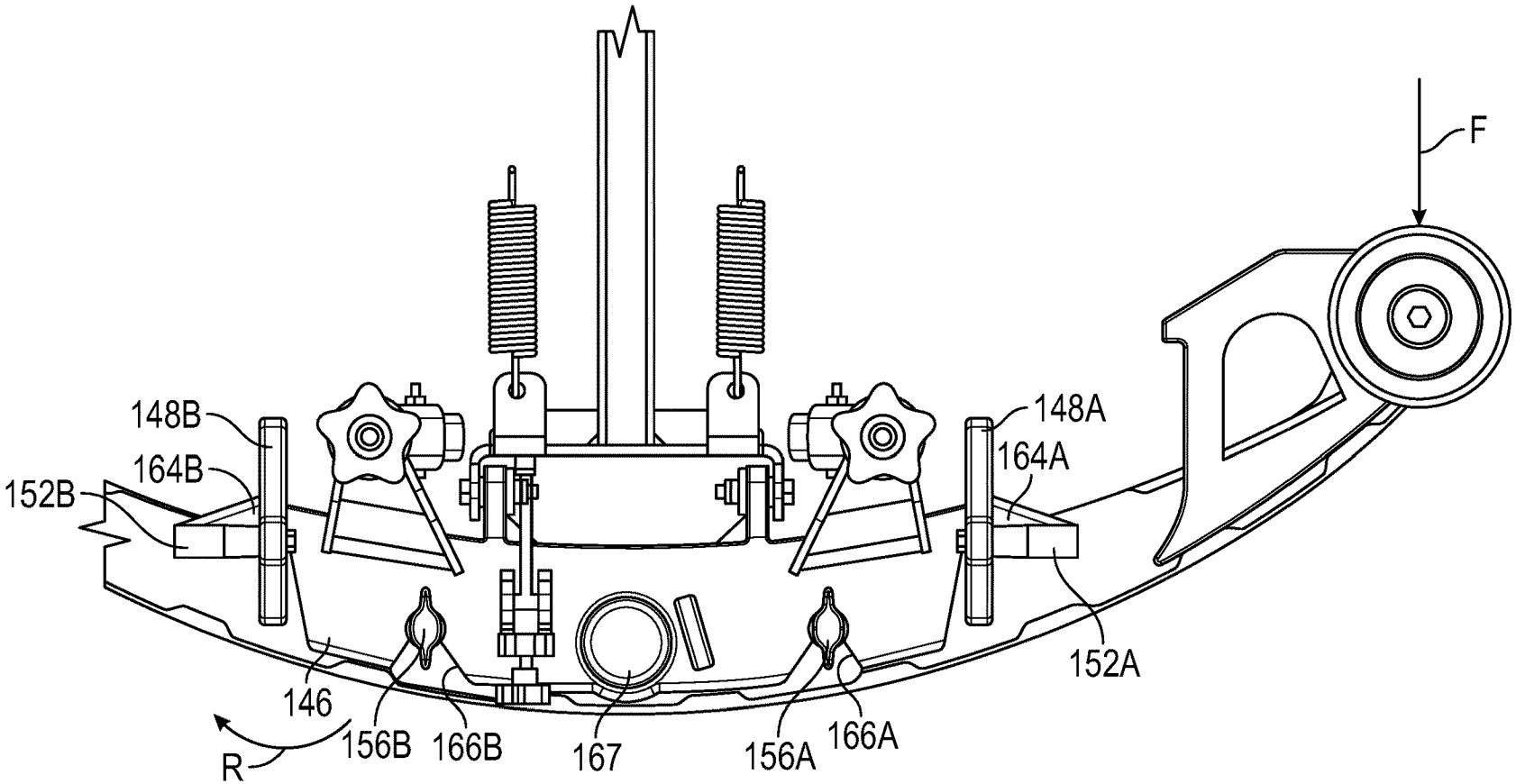
FIG. 8B is a partial top view of an assembled rear squeegee guide system of FIG. 8A.

FIGS. 8A and 8B—Squeegee Guide Handles

Conventional rear squeegee assemblies are designed to detach if an obstacle is encountered to avoid damaging the machine and the surroundings. Sometimes, however, the rear squeegee can get hung-up and fail to detach. Furthermore, maintenance is also required for the rear squeegee, so this assembly needs to be easily removed and reattached.

In order to address the foregoing problems, the present inventors have designed a rear squeegee assembly that includes handles in a location above the center of gravity of the rear squeegee assembly, with hangers that can align against a guide and support the squeegee during installation. The rear squeegee assembly can also include a geometry that allows the assembly to more readily detach from attachment mechanisms when the rear squeegee assembly encounters an obstacle.

FIG. 8A is an exploded view of rear squeegee system 18 of FIG. 1. FIG. 8B is a partial top view of an assembled rear squeegee guide system 18 of FIG. 8A. Squeegee system 18 can include attachment arm 140, squeegee mount, or guide, 142, and squeegee 144. Squeegee 144 can include frame 146, hangers 148A and 148B, rollers 150A and 150B, handles 152A and 152B, blade 154, fasteners 156A and 156B and suction port 157. Mount 142 can include various features for engaging arm 140, and casters 158A and 158B that can support squeegee 144 on the surface being cleaned. Mount 142 can be made of a body, such as plate 160 that has rear edge 162. Rear edge 162 can be shaped to have side wings 164A and 164B and receiving ports 166A and 166B. Mount 142 can also include suction port 167 that can align with suction port 157 and can be coupled to a suction hose from recovery system 20 (FIG. 1) to vacuum up dirty cleaning fluid.

Mount 142 can be coupled to arm 140 such that a top surface of plate 160 is parallel to the surface to be cleaned, such as surface S. When squeegee 144 is mounted to plate 10, hangers 148A and 148B of squeegee 144 can be positioned to engage wings 164A and 164B, respectively, and fasteners 156A and 156B are positioned to engage ports 166A and 166B, respectively.

Handles 152A and 152B can be positioned to extend from hangers 148A and 148B along a center of gravity of squeegee 144. For a longitudinal axis of squeegee 144 extending in the direction between rollers 150A and 150B, handles 152A and 152B can be positioned such that squeegee 144 will not tend to rotate about that axis. As such, a top surface of frame 146 can be parallel to a surface to be cleaned, such as surface S. Thus, mounting surfaces 168A and 168B of hangers 148A and 148B can extend parallel to a top surface of plate 160. Frame 146 can then be readily slid underneath plate 160, with hangers 148A and 148B extending over plate 160.

Handles 152A and 152B can be separate components attached to hangers 148A and 148B as shown in FIGS. 8A and 8B, or can be integral with hangers 148A and 148B in other examples. Alternatively, both hangers 148A and 148B and handles 152A and 152B can be configured to be removable from frame 146. In other examples, hangers 148A and 148B and handles 152A and 152B can be fabricated from a metal wire bent and shaped to provide the features described herein.

Ports 166A and 166B can open toward fasteners 156A and 156B so that frame 146 need not be exactly centered on plate 160 to fully seat with mount 142. Furthermore, surfaces 170A and 170B can be can be angled to guide hangers 148A and 148B into centering squeegee 144 onto mount 142. That is, starting from near wings 164A and 164B, surfaces 170A and 170B can converge toward each other as they extend toward rear surface 162 to provide a wider window for receiving hangers 148A and 148B. As surfaces 170A and 170B diverge in the opposite directing, surfaces 170A and 170B can push hangers 148A and 148B into alignment so fasteners 156A and 156B will be centered in ports 166A and 166B. Thus, fasteners 156A and 156B can be tightened down into frame 146 to draw collars 172A and 172B tightly down onto plate 160 to immobilize squeegee 146, pulling frame 146 into tight engagement with the underside of plate 160.

With reference to FIG. 8B, fasteners 156A and 156B are configured to securely hold squeegee 144, but to allow squeegee 144 to back out of ports 166A and 166B. As a force F impacts squeegee 144, such as at roller 150A, frame 146 is configured to pivot or rotate at the intersection of hanger 148B and wing 164B, as indicated by arrow R. As such, both of fasteners 156A and 156B will disengage from ports 166A and 166B, respectively, allowing frame 146 to freely separate from mount 142.

In previous design, without the pivot point at wing 164B and hanger 148B, squeegee 146 would rotate about fastener 156B after fastener 156A disengages. There was, therefore, the potential for hanger 146 to remain partially attached to mount 142, which can potentially damage squeegee 146. Additionally, in the present design, the suction hose is designed to attach to mount 142 rather than squeegee 146 as has been done in previous designs. As such, if squeegee 146 becomes detached from mount 142, the suction hose does not become damaged or compromised as squeegee 146 is dragged along behind floor cleaning system 10.

Figure 9:
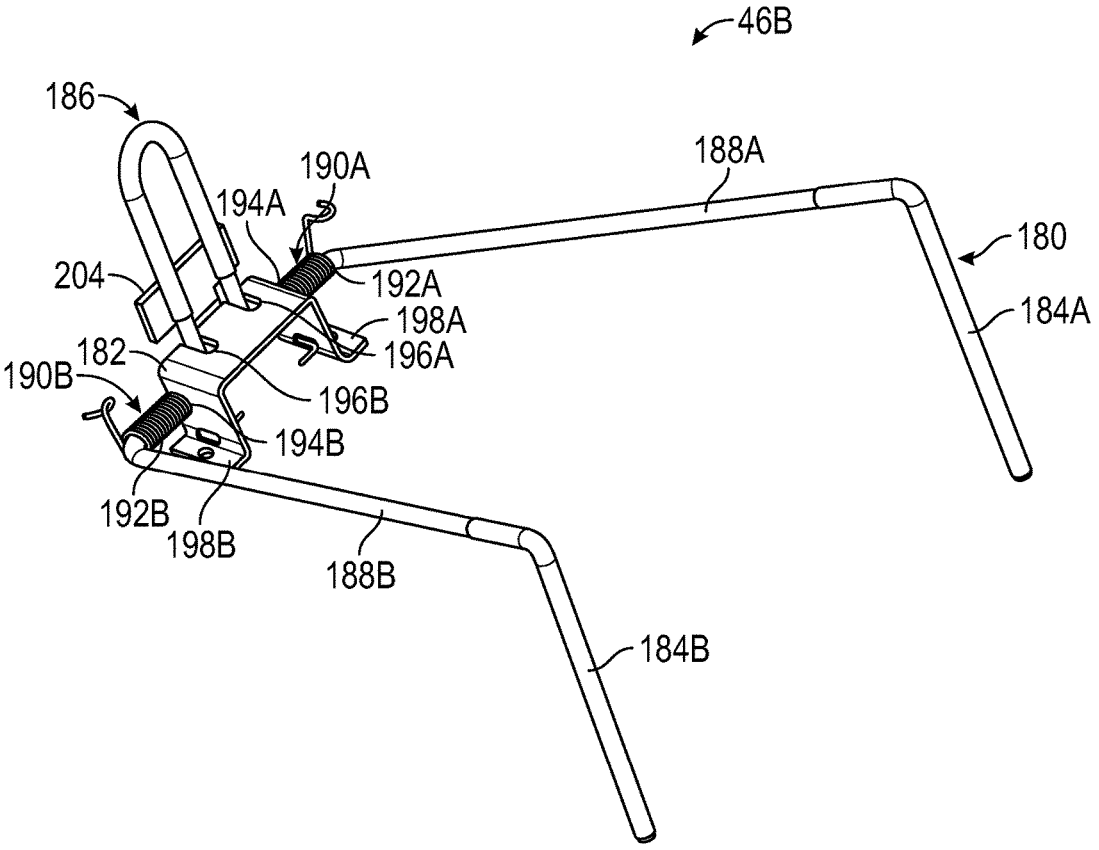
FIG. 9 is a perspective view of a disc scrubber alignment mechanism of FIG. 3A.
Figure 10A:
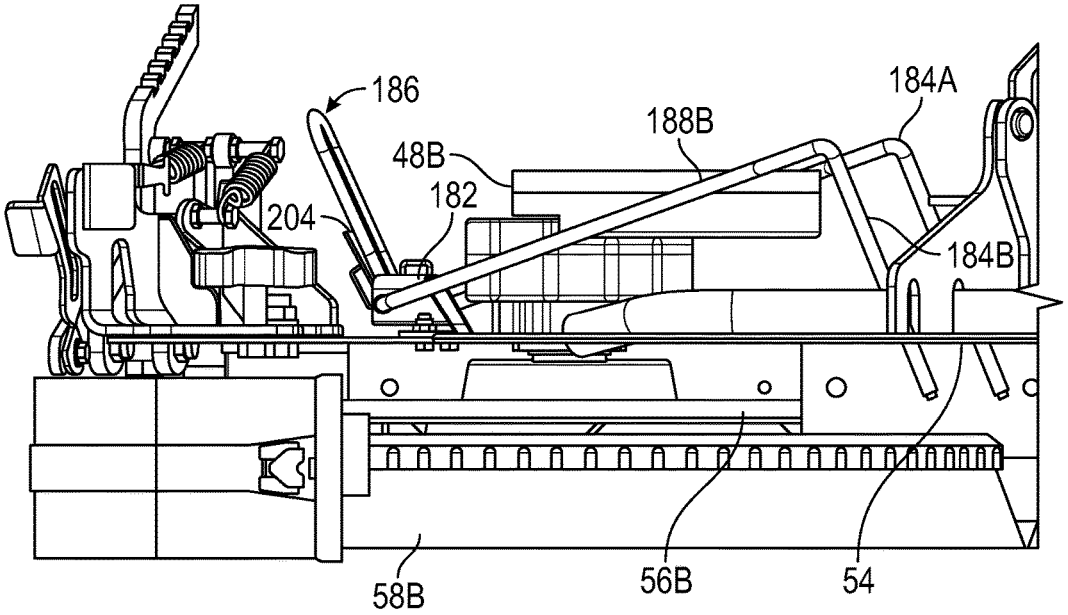
FIGS. 10A and 10B are perspective views of the disc scrubber alignment mechanism of FIG. 9 in raised and lowered positions, respectively.
Figure 10B:
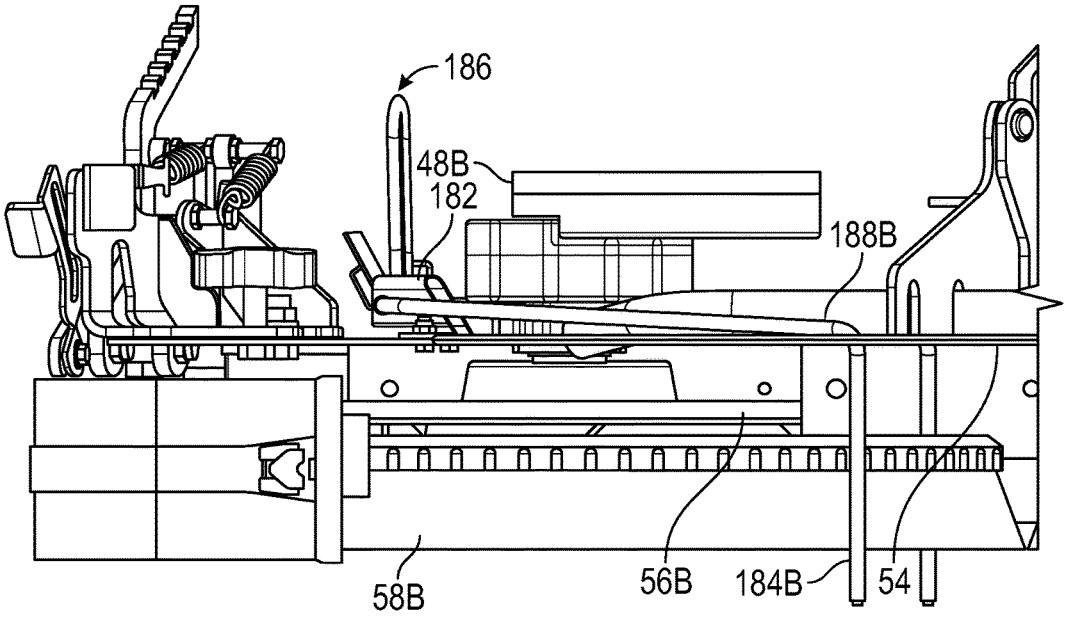

FIGS. 9, 10A and 10B—Brush Centering Mechanism

Floor scrubbing machines often use brushes that rotate on an axis perpendicular to the floor. The brushes are housed in a deck that lowers and raises. The brushes are held on by a snap clip on the brush plate assembly. The brush plate is connected to the motors on the deck. The brush has lugs on it that snap into the clips on the brush plate. These brushes need to be removed and replaced. To reassemble the brushes, they are slid under the deck, the deck is lowered and the motors are spun to engage the lugs into the snap clips. The difficulty in this process is aligning the brush to the centerline of the motor and brush plate. If the brushes are not centered, the lugs will not engage and the operator must dismount the scrubbing matching, re-position the brushes and then attempt to reengage the lugs with the snap clips.

The present inventors have developed a new alignment or centering device design. Generally speaking, the design includes retractable locators configured to center the brushes for assembly.

FIG. 9 is a perspective view of disc scrubber alignment mechanism, or centering mechanism, 46 suitable for use as alignment mechanisms 46A and 46B of FIG. 3A. Alignment mechanism 46 can include wire 180 and bracket 182. Wire 180 can be bent or formed to include alignment posts 184A and 184B and handle 186. More particularly, wire 180 can be bent to form first alignment post 184A, first arm 188A, first shaft portion 190A, u-shaped handle 186, second shaft portion 190B, second arm 188B and second alignment post 184B.

First and second shaft portions 190A and 190B can engage slots 194A and 194B on a side of bracket 182, while u-shaped handle 186 can extend through slots 196A and 196B on a top surface of bracket 182. Springs 192A and 192B can be positioned on first and second shaft portions 190A and 190B, respectively. Opposite ends of springs 192A and 192B can be configured to engage bracket 182 and arms 188A and 188B, respectively, to bias alignment posts 184A and 184B to an up or raised position.

FIGS. 10A and 10B are perspective views of disc scrubber alignment mechanism 46 of FIG. 9 in raised and lowered positions, respectively. Bracket 182 can be mounted to deck 54 at flanges 198A and 198B (FIG. 9). For example, flanges 198A and 198B can be mounted to posts 200A and 200B (FIG. 3B). Alignment posts 184A and 184B can at least extend partially through deck 54. For example, posts 184A and 184B can extend through openings 202A and 202B (FIG. 3B) is deck 54 when bracket 182 is mounted to posts 200A and 200B. Springs 192A and 192B can bias wire 180 so that posts 184A and 184B are in an elevated position, as shown in FIG. 10A, above the level of disc hub 56B. In particular, with reference to FIG. 10A, springs 192A and 192B can cause wire 180 to be rotated counterclockwise such that handle 186 engages plate 204. Plate 204 therefore can limit rotation of handle 186 and wire 180 away from deck 54. Thus, in the retracted position of FIG. 10A, wire 180 can be positioned to not interfere with the operation of any other components of floor cleaning system 10. Additionally, alignment mechanisms 46A and 46B are positioned relative to each other so as to not interfere with each other. For example, as can be seen with reference to FIG. 3B, drive motors 48A and 48B can be positioned next to each other such that an axis A extends through the center of each drive motor 48A and 48B and the center of each drive opening 206A and 206B. However, an axis for each pair of posts 200A and 200B can be positioned relative to axis A at different angles such that the respective pair of alignment posts 184A and 184B do not interfere with each other. As can be seen in FIG. 3B, opening 202A is offset from opening 202C.

As described above, it can be occasionally necessary to change out disc brush 58B from disc hub 56B, which subsequently can entail aligning a new disc brush 58B with disc hub 56B in order to secure the new disc brush 58B to disc hub 56B. Wire 180 can be readily lowered by pushing handle 186 away from plate 204 to cause alignment posts 184A and 184 to lower alongside disc brush 58B and disc hub 56B. To reassemble the new disc brush 58B, the operator can push on handle 186 of alignment mechanism 46 to lower alignment posts 184A and 184B through deck 54, then the new disc brush 58B can be slid under deck 54 until it makes contact with alignment posts 184A and 184C. At that point, the new disc brush 58B will be centered under disc hub 56B and drive motor 48B and handle 186 can be disengaged. In particular, alignment posts 184A and 184B are positioned on deck 54 a distance away from drive opening 206 (FIG. 3B) in deck 54 slightly greater than the radius of disc brush 58B. Drive opening 206 is positioned to receive a drive shaft of drive motor 48B, which aligns with the center of disc hub 56B. As such, when the circumference of disc brush 58B contacts alignment posts 184A and 184B, the center of the disc brush 58B will align with the center of disc hub 56B and drive motor 48B.

After both new disc brushes 58A and 58B are centered, a button can be pressed on a user interface panel, such as control panel 122 of FIG. 7B, to initiate the following sequence controlled by software: 1) actuators lower scrub deck 54 slowly, 2) as deck 54 begins lowering, both drive motors 48A and 48B are turned on at a low speed, 3) rotating disc hubs 56A and 56B then contact three drive lugs on the new disc brushes 58A and 58B—while the actuators continue to lower deck 54, 4) disc hubs 56A and 56B drop over the lugs as soon as they meet the larger slots in disc hubs 56A and 56B, 5) the speed of drive motors 48A and 48B can then increase for a few seconds to make sure the lugs are locked into the spring retainers attached to disc hubs 56A and 56B, 6) drive motors 48A and 48B are then turned off, and 7) then the actuators for deck 54 raise deck 54 to its original position.

Figure 12A:
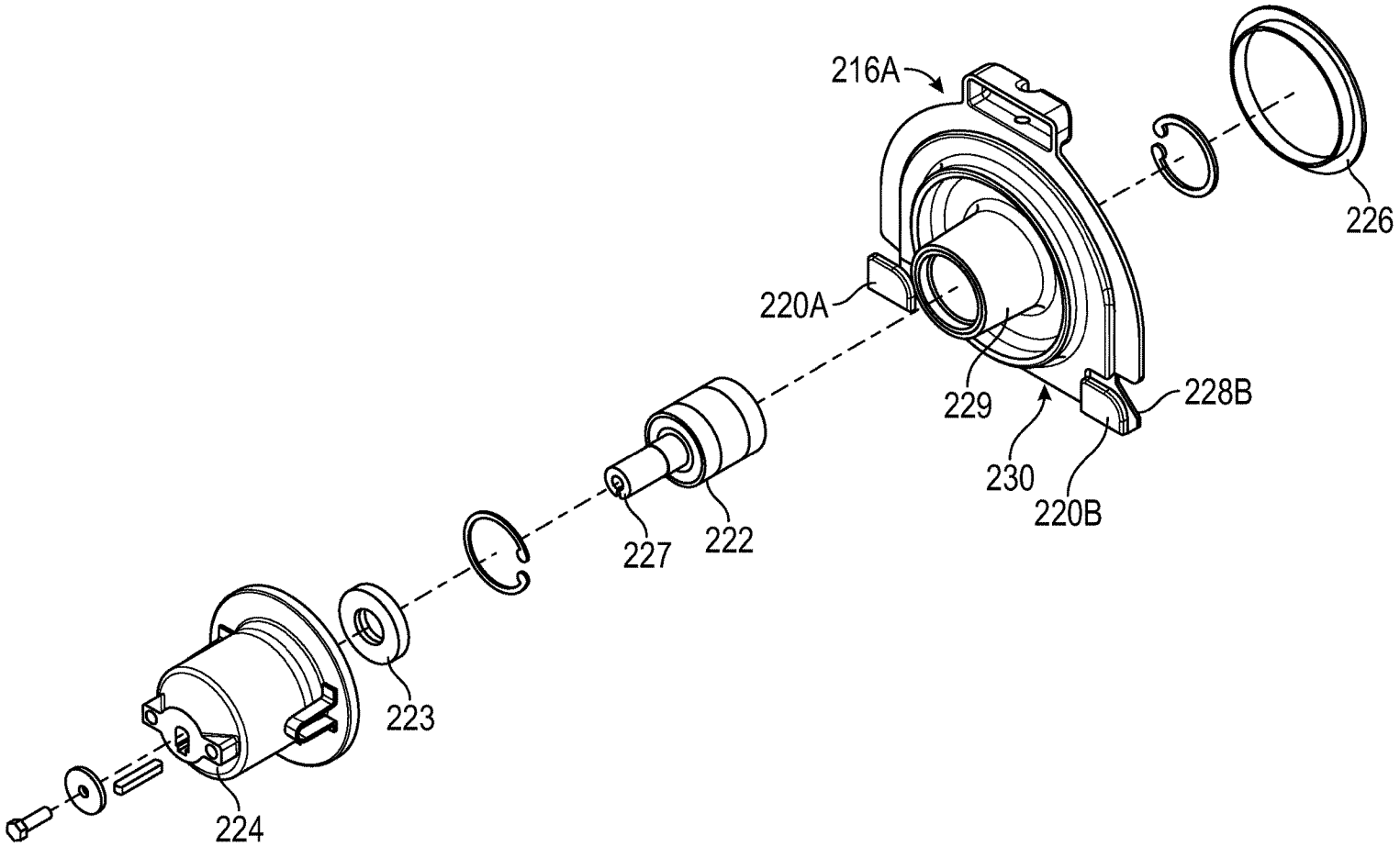
FIG. 12A is an exploded view of an idler cover system for the cylindrical scrub system of FIG. 11.
Figure 12B:
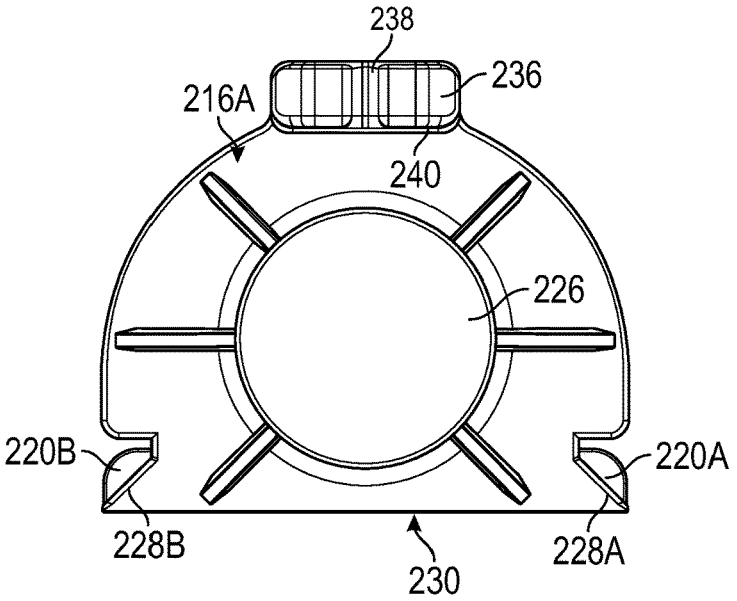
FIG. 12B is a front view of an idler cover of the idler cover system of FIG. 12A.
Figure 12C:
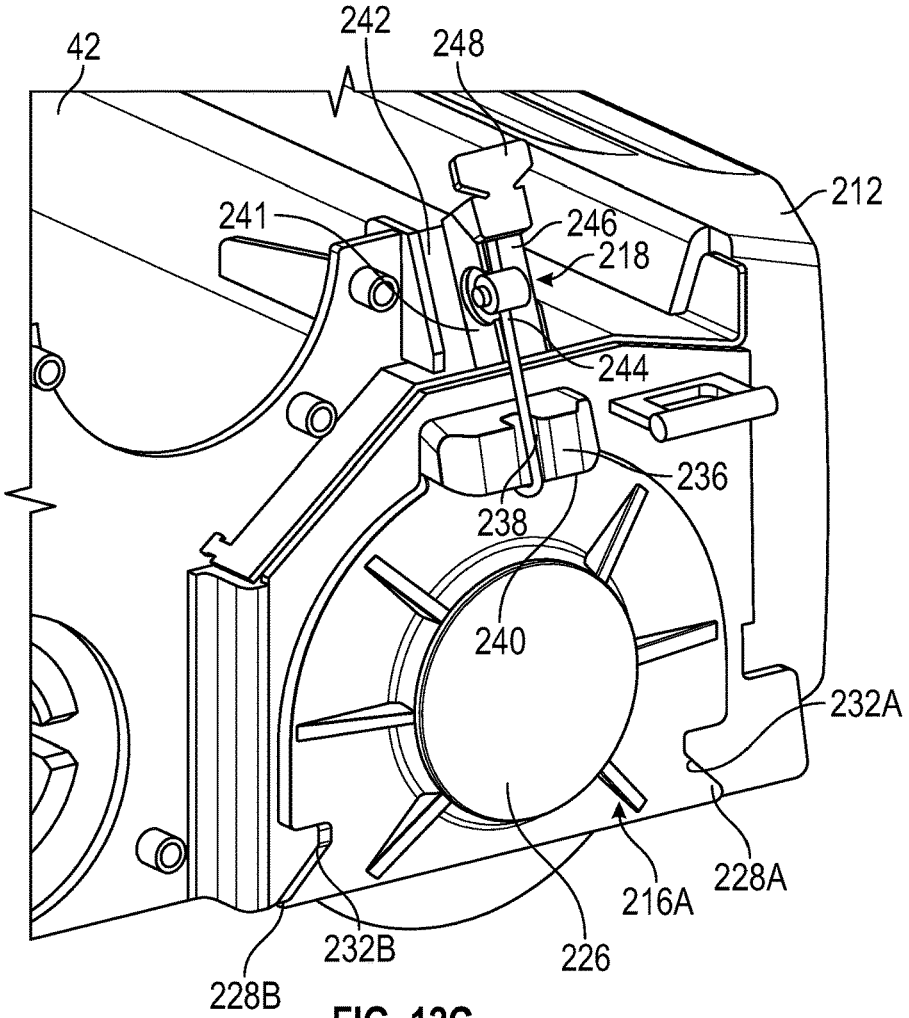
FIG. 12C is a perspective view of the idler cover system of FIGS. 12A and 12B attached to a scrub deck via a latch mechanism.

FIGS. 12A, 12B and 12C—Idler End Cylindrical Brush Cover

Figure 11:
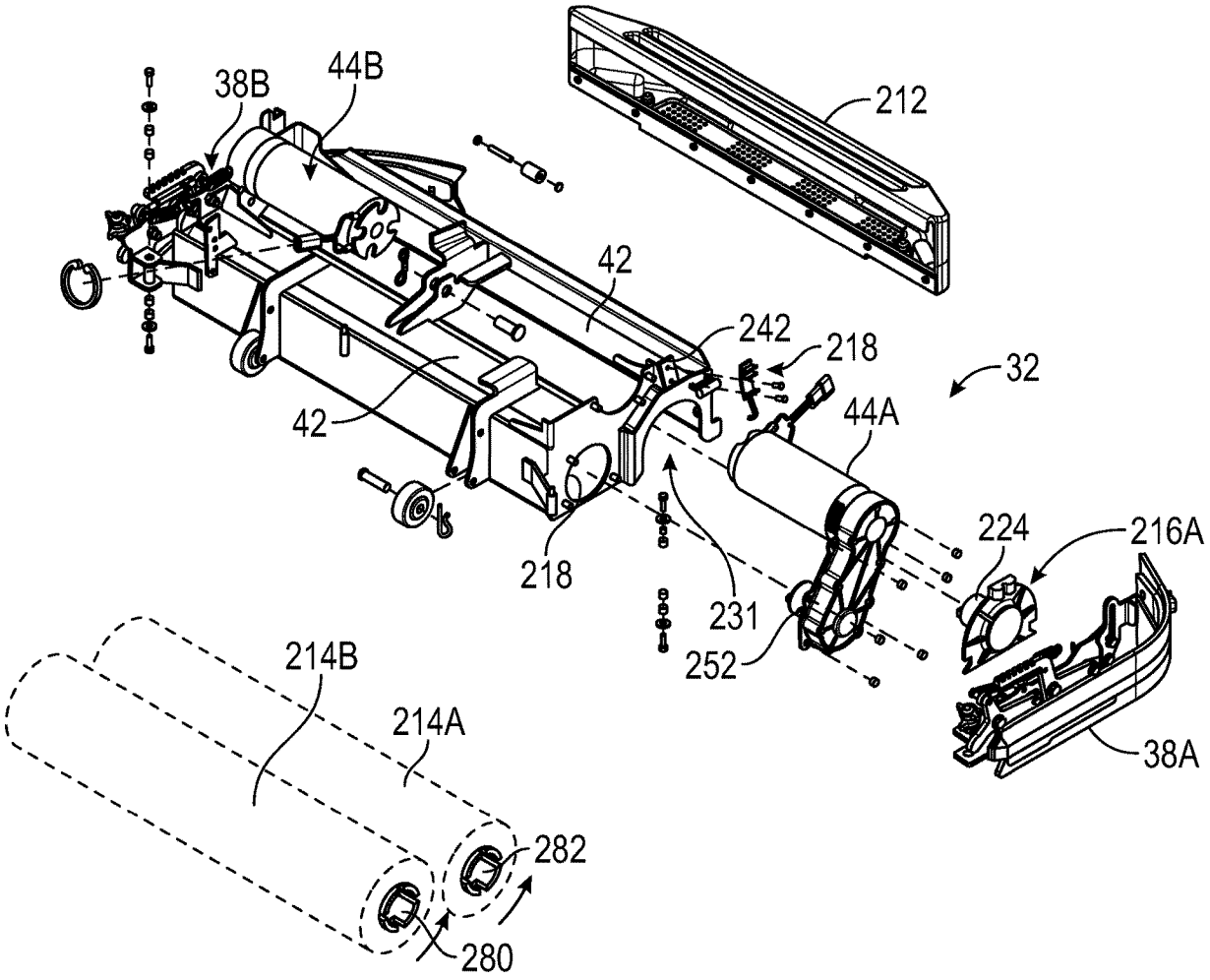
FIG. 11 is a front perspective view of the cylindrical scrub system of FIG. 2A without door assemblies attached.

FIG. 11 is a front perspective view of cylindrical scrub system 32 of FIG. 2A without door systems 50A and 50B attached so that side skirts 38A and 38B can be seen. Scrub system 32 can also include deck 42, self-contained drive mechanisms 44A and 44B, hopper assembly 212, brushes 214A and 214B, and covers 216A and 216B. FIGS. 12A-12C show various exploded, end and perspective views of cover 216A.

Cylindrical brushes 214A and 214B can rotate on axes parallel to a scrub surface such as a floor. The idler end for a cylindrical brush is the non-driven end of the brush. The idler end allows free rotational movement of the brush, while supporting it sufficiently to provide down pressure for cleaning the floor. The idler end can be supported by covers 216A and 216B (not shown) that are advantageously removable in order to service brushes 214A and 214B relatively easily, but needs to lock into place during operation. Brushes 214A and 214B are enclosed on the top and sides by a weldment, called a scrub deck 42. This weldment has openings at both ends for a brush drive motor, e.g., self-contained drive mechanisms 44A and 44B and idler end covers 216A an 216B.

Typically, in the past, the idler end cover was mounted to the deck with tabs and a threaded knob. This required the cover to be moved around to line up the tabs, then the cover to be slid in, hooking the tabs on the deck. The stud that the threaded knob was on would then be slid into a notch on the deck and tightened down.

The present inventors have developed a new design wherein the knob is replaced with draw latch 218 for easier assembly, and incorporated guide tabs 220A and 220B into cover 216A to locate cover 216A relative to deck 42 during assembly. The idler end cover 216A can be incorporated into an assembly including shaft 222, seal 223, brush lug 224 and cap 226. Brush lug 224 mounts on shaft 222 using shaft 227, which is captured in socket 229 in the casting for cover 216A. Lug 224 rides within a recess in cover 216A such that lug 224 provides a sealing mechanism. For example, cleaning fluid must travel past the interface between lug 224 and cover 216A, back along socket 229 and then past seal 223 before encountering shaft 222 and any bearings provided therein. Cap 226 can snap into cover 216A to conceal and protect the end of shaft 222, but can be easily taken off to remove shaft 222 and other components.

Cover 216A can have angled tabs 228A and 228B at bottom edge 230 to center cover 216A in opening 231 in the bottom edge of deck 42. In particular, opening 231 includes angled surfaces 232A and 232B (FIG. 12C) that engage with angled tabs 228A and 228B. Tabs 220A and 220B are disposed opposite angled tabs 228A and 228B to form first and second side channels, respectively to receive a bottom edge of deck 42. Tabs 220A and 220B can thus also slide around the bottom edge of deck 42 to keep cover 216A from moving up or in the direction of the axis of brush 214A.

The top of cover 216A can also have angled tab 236 with groove 238 and hook 240. As such, cover 216A can define bottom edge 230 that can be flat, a top portion having angled tab 236 and side portions connecting bottom edge 230 and angled tab 236. Base 241 of draw latch 218 can be mounted on flange 242 of deck 42 at the same angle as tab 236. Draw arm 244 can engage an underside of tab 236 at hook 240. Draw latch 218 can operate in a conventional manner, such as by having swing body 246 pinned to base 241 at a first end and pinned to draw arm 244 at a second end. As such, finger tab 248 can be rotated down, away from flange 242, to allow draw latch 218 to fit under hook 240 and can then be rotated up, toward flange 242, to tightly pull cover 216A up and into opening 231 in deck 42, with draw arm 244 laying flush in groove 238

The angles of tabs 228A and 228B can help keep cover 216A clean and functioning properly. Tabs 228A and 228B also open to the outside, preventing debris from collecting therein.

Figure 13A:
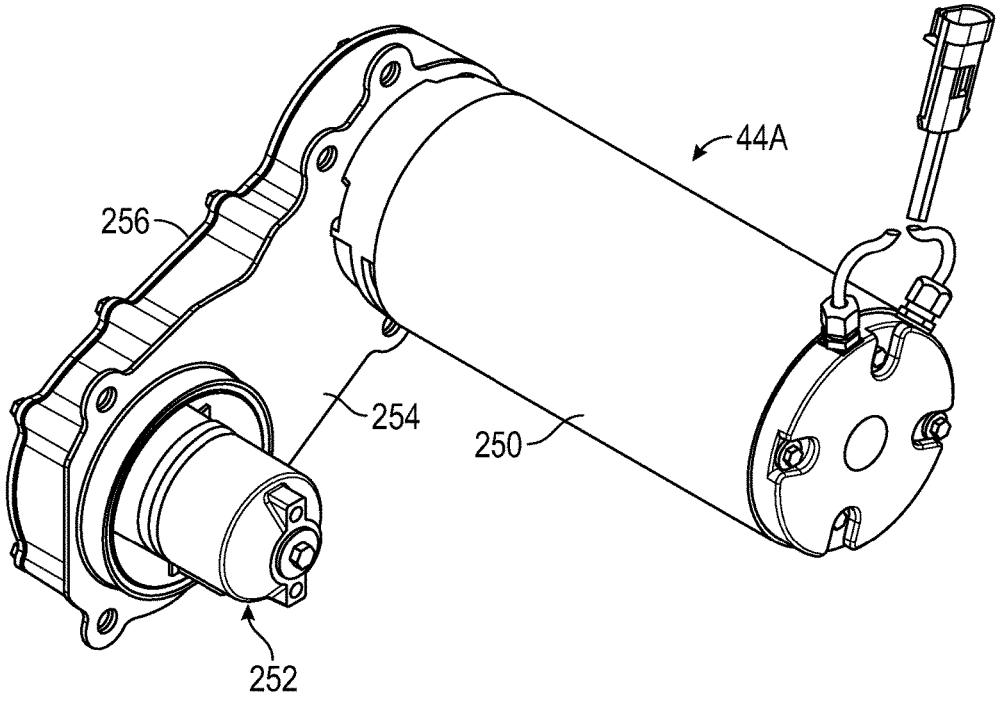
FIG. 13A is a perspective view of a self-contained drive mechanism of the cylindrical scrub system of FIG. 11.
Figure 13B:
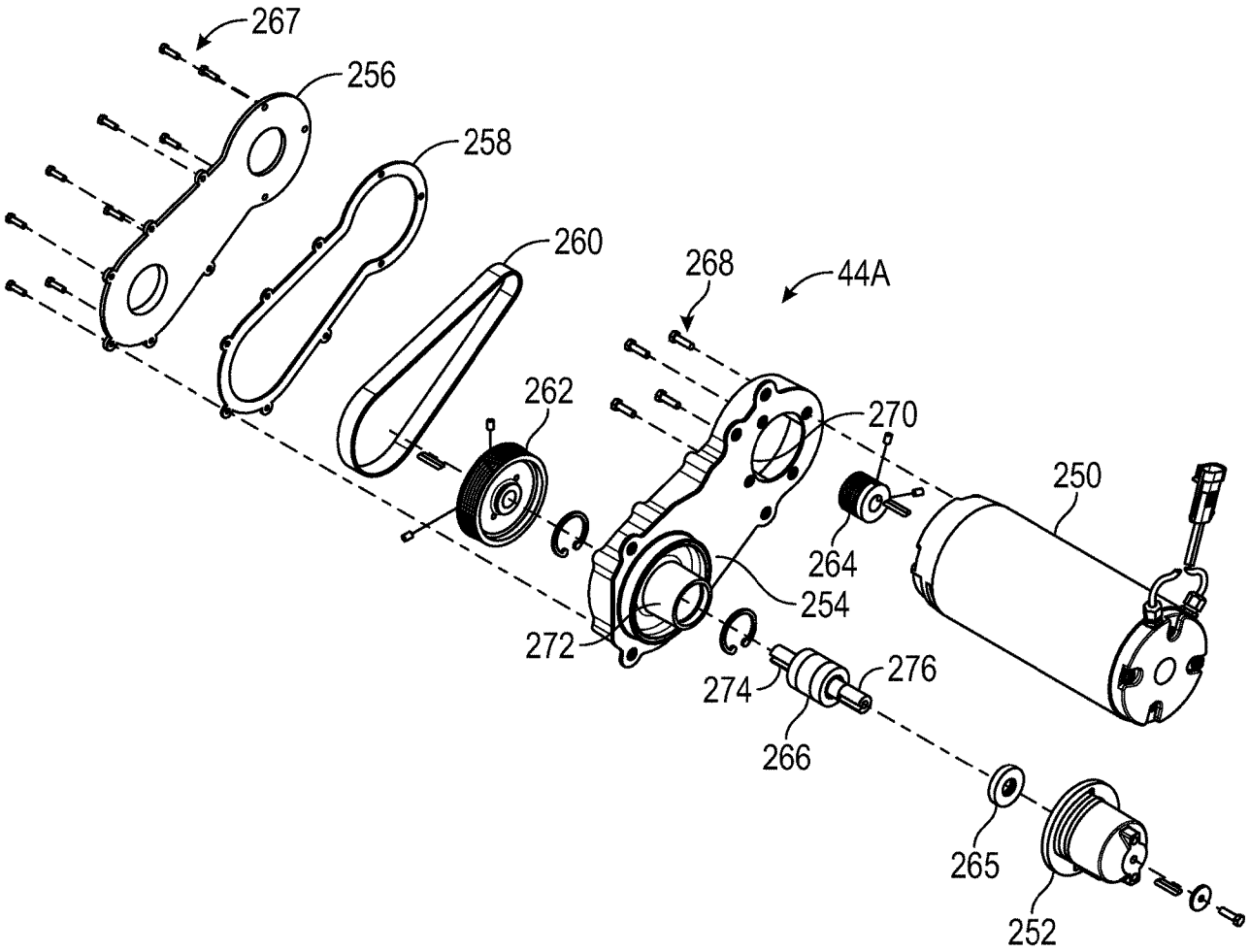
FIG. 13B is an exploded view of the self-contained drive mechanism of FIG. 13A.

FIGS. 13A and 13B—Self-Contained Cylindrical Drive End

The motors that drive the cylindrical brushes have been mounted directly to the scrub deck in the past. The lug that interfaced the brush was also previously mounted to the scrub deck. The lug was connected to the motor using a belt.

The present inventors have developed a new design that includes self-contained drive mechanism 44A that can mount to scrub deck 42, with motor 250 and lug 252 mounting to it. This allows the mechanical drive mechanism 44A to be assembled independently of scrub deck 42. Belt 260 can be contained and protected within self-contained drive mechanism 44A. Self-contained drive mechanism 44A can then be mounted to scrub deck 42. This allows parts to be removed from scrub deck 42 and serviced on a bench where it is easier to access the components.

FIGS. 13A and 13B show self-contained drive mechanism 44A having housing 254 to which both motor 250 and lug 252 can be mounted. Housing 254 can be a single or monolithic piece, such as a casting with removable cover 256. As can be seen in FIG. 13B, self-contained drive mechanism 44A can also include gasket 258, belt 260, sheave 262, sheave 264, seal 265, and idler shaft 266.

Cover 256 can be coupled to housing 254 using fasteners 267 to, among other things conceal and protect belt 260 within housing 254. Motor 250 can be mounted to housing 254 using fasteners 268 such that a drive shaft (not shown) of motor 250 extends through opening 270 within housing 254. Drive mechanism 44A can be mounted to deck 42 also using suitable fasteners, as indicated in FIG. 11.

Sheave 264 can be attached to the drive shaft and secured using a fastener. Idler shaft 266 can be inserted into socket 272 such that shaft 274 extends into housing 254. Sheave 262 can be attached to shaft 274 and secured using a fastener. Lug 252 can be positioned around socket 272 such that shaft 276 is inserted into a mating bore within lug 252. As such, idler shaft 266, which may include a bearing element, can ride within socket 272 supporting both sheave 262 and lug 252. Shafts 274 and 276 can be keyed to sheave 262 and lug 252 to promote co-rotation. During operation, motor 250 can turn its corresponding drive shaft, which rotates sheave 264. Belt 260 can be placed over sheave 264 and sheave 262 such that sheave 262 is also driven in the direction of the drive shaft of motor 252. Due to the ratio of the diameters of sheave 262 and 264, sheave 262 can rotate faster than sheave 264. Sheave 262 can drive idler shaft 266, which correspondingly rotates lug 252. As shown in FIG. 11, lug 252 can be inserted through opening 278 in deck 42 and into socket 280 in brush 214B. Likewise, lug 224 of cover 216A can be inserted through opening 231 in deck 42 and into socket 282 in brush 214A. Lug 224 can operate in a similar fashion as lug 252, except shaft 222 only includes a single shaft 227 for supporting lug 224 and does not include a second shaft for mounting to a drive sheave. As such, opposite ends of each of cylindrical brushes 214A and 214B can be supported by one of lug 224 and lug 252 as described herein.

Various Notes & Examples

Example 1 can include or use subject matter such as a skirt mechanism for a floor scrubber configured to selectively partially guide cleaning fluid alongside a rotary brush of the floor scrubber, the skirt mechanism can comprise: a mount for coupling to a floor scrubber; a first arm rotatably connected to the mount, the first arm having a lever; a second arm rotatably connected to the mount; a blade support rotatably connected to the first and second arms; and a latch connecting the mount and the blade support, the latch including a slot configured to hold the blade support relative to the mount in raised and lowered positions; wherein the slot is shaped such that the lever can be depressed to both raise and lower the blade support to the raised and lowered positions.

Example 2 can include, or can optionally be combined with the subject matter of Example 1, to optionally include a slot that can comprise: an elongate channel extending along an axis; a V-shaped notch located at an end of the elongate channel, the V-shaped notch being offset relative to the axis; and a notch disposed opposite the V-notch at the end of the elongate channel.

Example 3 can include, or can optionally be combined with the subject matter of one or any combination of Examples 1 or 2 to optionally include a latch that can be pinned to the blade mount at the slot.

Example 4 can include, or can optionally be combined with the subject matter of one or any combination of Examples 2 or 3 to optionally include an angle between a bottom angled surface of the V-notch and a plane extending between a pin pinning the blade mount at the slot and a pin connecting the latch to the blade support is in the range of approximately 51 degrees to approximately 71 degrees in the raised position.

Example 5 can include, or can optionally be combined with the subject matter of one or any combination of Examples 1 through 5 to optionally include a first arm that can comprise: a first portion having through-holes for receiving fasteners to connect the first arm to the mount and the blade support; and a jog portion for offsetting the lever from the first portion.

Example 6 can include, or can optionally be combined with the subject matter of one or any combination of Examples 1 through 5 to optionally include a lever that can include corrugations.

Example 7 can include or use subject matter such as a skirt mechanism for a floor scrubber configured to guide cleaning fluid alongside a rotary brush of the floor scrubber, the skirt mechanism can comprise: a mount for coupling to a floor scrubber; a first arm rotatably connected to the mount; a second arm rotatably connected to the mount; a blade support rotatably connected to the first and second arms; a clip pinned to the blade mount at a notched channel; a first spring connecting the first arm to the clip to cause rotation of the first arm; and a second spring connecting the second arm to the blade mount to cause rotation of the second arm.

Example 8 can include, or can optionally be combined with the subject matter of Example 7, to optionally include a notched channel that can be shaped to allow the clip to remain in first and second positions relative to the blade mount wherein distances between the clip and the first arm are different in the first and second positions to adjust tension in the first spring.

Example 9 can include, or can optionally be combined with the subject matter of one or any combination of Examples 7 or 8 to optionally include a notched channel that can comprise: an elongate channel extending along an axis; and an arcuate notch located at an end of the elongate channel.

Example 10 can include, or can optionally be combined with the subject matter of one or any combination of Examples 7 through 9 to optionally include a clip that can includes a finger tab.

Example 11 can include, or can optionally be combined with the subject matter of one or any combination of Examples 7 through 10 to optionally include a rod that can connect the first arm and the second arm.

Example 12 can include or use subject matter such as a floor scrubber machine that can comprise: a chassis; a set of wheels connected to the chassis; a motor mounted on the chassis and connected to the set of wheels to provide propulsion for the floor scrubber machine; and a throttle device for controlling the motor, the throttle device that can comprise: an acceleration pedal that can comprise: a first end pivotable proximate the chassis to control a speed of the motor; and a second end displaceable relative to the chassis via rotation of the first end; and a button mounted to the acceleration pedal proximate the second end to control forward and backward rotation of the motor.

Example 13 can include, or can optionally be combined with the subject matter of Example 12, to optionally include a first end that can be hinged at the chassis.

Example 14 can include, or can optionally be combined with the subject matter of one or any combination of Examples 12 or 13 to optionally include a second end of the acceleration pedal that can include a lobe and the button is located on the lobe.

Example 15 can include, or can optionally be combined with the subject matter of one or any combination of Examples 12 through 14 to optionally include a button that can include a first switch.

Example 16 can include, or can optionally be combined with the subject matter of one or any combination of Examples 12 through 15 to optionally include a first switch that can be selected from the group consisting of: a double pull switch, a proximity switch, a pressure sensor switch, and a photo switch.

Example 17 can include, or can optionally be combined with the subject matter of one or any combination of Examples 12 through 16 to optionally include an acceleration pedal that can have a first resistance required to be overcome to rotate the acceleration pedal; and a button that can have a second resistance required to be overcome to depress the button; wherein the first resistance is greater than the second resistance.

Example 18 can include, or can optionally be combined with the subject matter of one or any combination of Examples 12 through 17 to optionally include a second switch that can be connected to the acceleration pedal to control the speed based on a position of the acceleration pedal over a range of motion; and a control panel that can be connected to the motor, the first switch and the second switch; wherein the control panel can rescale output of the second switch across the range of motion.

Example 19 can include, or can optionally be combined with the subject matter of one or any combination of Examples 12 through 18 to optionally include a control panel that can limit a signal sent from the second switch to the motor.

Example 20 can include, or can optionally be combined with the subject matter of one or any combination of Examples 12 through 19 to optionally include a first switch that can be deactivated if the second switch is first activated.

Example 21 can include or use subject matter such as a squeegee system for a floor scrubber, the squeegee system can comprise: an elongate mounting plate for connecting to a floor scrubber, the elongate mounting plate comprising a rear edge and first and second wings disposed at opposite end portions of the rear edge; a frame plate comprising first and second hangers disposed between ends of the frame plate, the first and second hangers configured to engage the first and second wings, respectively; and a wiper blade mounted to the frame plate; wherein first and second engagements between the first wing and the first hanger and the second wing and the second hanger, respectively, define fulcrum points for rotation of the frame plate relative to the elongate mounting point.

Example 22 can include, or can optionally be combined with the subject matter of Example 21, to optionally include a first engagement that can define a first fulcrum point when the second engagement becomes separated, and the second engagement that can define a second fulcrum point when the first engagement becomes separated.

Example 23 can include, or can optionally be combined with the subject matter of one or any combination of Examples 21 or 22 to optionally include an elongate mounting plate that can include tapered edges to guide the first and second hangers onto the first and second wings.

Example 24 can include, or can optionally be combined with the subject matter of one or any combination of Examples 21 through 23 to optionally include tapered edges that can center the frame plate relative to the elongate mounting plate.

Example 25 can include, or can optionally be combined with the subject matter of one or any combination of Examples 21 through 24 to optionally include first and second fasteners mounted to the frame plate; and first and second ports on the elongate mounting plate to receive the first and second fasteners, respectively.

Example 26 can include, or can optionally be combined with the subject matter of one or any combination of Examples 21 through 25 to optionally include first and second handles that can extend from the first and second hangers, respectively, wherein the first and second handles can be located along a center of gravity of the frame plate such that the frame plate rests horizontally when supported only by the first and second handles.

Example 27 can include or use subject matter such as a scrub deck assembly for a floor scrubber, the scrub deck can comprise: a deck body having an outer surface and an inner surface; a motor mounted to the outer surface of the deck body, the motor having a drive shaft extending through the deck body to the inner surface; first and second ports in the deck body located equidistant from the drive shaft; and a first alignment mechanism that can comprising: a first bracket mounted to the outer surface of the deck body; first and second arms rotatably extending from the first bracket opposite the outer surface of the deck body; and first and second alignment posts extending from the first and second arms, respectively; wherein the first and second arms locate the first and second alignment posts with the first and second ports, respectively.

Example 28 can include, or can optionally be combined with the subject matter of Example 27, to optionally include a brush mounted to the drive shaft, the brush can have an outer diameter, wherein the first and second ports are disposed along the outer diameter.

Example 29 can include, or can optionally be combined with the subject matter of one or any combination of Examples 27 or 28 to optionally include an alignment mechanism that can further comprise a handle connected to the first and second arms for rotating the first and second arms.

Example 30 can include, or can optionally be combined with the subject matter of one or any combination of Examples 27 through 29 to optionally include and alignment mechanism that can further comprise a spring to bias the first and second arms away from the outer surface of the deck body such that the first and second alignment posts are retracted from the first and second ports, respectively.

Example 31 can include, or can optionally be combined with the subject matter of one or any combination of Examples 27 through 30 to optionally include third and fourth ports in the deck body; and a second alignment mechanism mounted to the deck body, the second alignment mechanism can comprise: a second bracket mounted to the outer surface of the deck body; third and fourth arms rotatably extending from the second bracket opposite the outer surface of the deck body; and third and fourth alignment posts extending from the third and fourth arms, respectively; wherein the third and fourth arms locate the third and fourth alignment posts with the third and fourth ports, respectively; wherein an axis extending through the third and fourth ports is non-parallel to an axis extending through the first and second ports.

Example 32 can include or use subject matter such as an idler end brush cover for a scrubber deck of a floor scrubber, the idler end brush cover can comprise: a cover body that can comprise: a flat lower edge; an upper portion; and first and second side portions connecting the flat lower edge and the upper portion; first and second angled notch surfaces located in the first and second side portions at opposite ends of the flat lower edge; and first and second tabs extending from the cover body opposite the first and second angled notch surfaces to form first and second channels, respectively, in the first and second side portions.

Example 33 can include, or can optionally be combined with the subject matter of Example 32, to optionally include a scrub deck having a bottom edge with an opening for receiving the cover body, the opening having angled surfaces configured to mate with the first and second angled notch surfaces when the bottom edge is disposed in the first and second channels.

Example 34 can include, or can optionally be combined with the subject matter of one or any combination of Examples 32 or 33 to optionally include an angled tab located on the upper portion, the angled tab can comprise: a groove; and a hook facing the flat lower edge.

Example 35 can include, or can optionally be combined with the subject matter of one or any combination of Examples 32 through 34 to optionally include a latch mechanism mounted to the scrub deck, the latch mechanism can have a draw arm configured to connect to the hook and lay in the groove.

Example 36 can include, or can optionally be combined with the subject matter of one or any combination of Examples 32 through 35 to optionally include a socket extending from the cover body; a shaft disposed in the socket; and a lug that receives the shaft and the socket such that the shaft is sealed between the lug and the cover body.

Example 37 can include or use subject matter such as a self-contained drive mechanism for a floor scrubber, the self-contained drive mechanism can comprise: a housing comprising a first opening and a second opening; a motor coupled to the first opening such that a drive shaft of the motor extends into the housing; an idler shaft disposed in the second opening; a lug coupled to a first end of the idler shaft outside the housing; a first sheave connected to the drive shaft inside the housing; a second sheave connected to the idler shaft inside the housing; and a belt connecting the first sheave and the second sheave.

Example 38 can include, or can optionally be combined with the subject matter of Example 37, to optionally include a cover that can be connected to the housing to conceal the belt in the housing, the cover having first and second openings to access the first and second sheaves, respectively.

Example 39 can include, or can optionally be combined with the subject matter of one or any combination of Examples 37 or 38 to optionally include a second opening that can includes a socket into which the idler shaft is disposed and around which the lug is disposed.

Example 40 can include, or can optionally be combined with the subject matter of one or any combination of Examples 37 through 39 to optionally include a seal disposed between the idler shaft and the lug inside the socket.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A skirt mechanism for a floor scrubber configured to selectively partially guide cleaning fluid alongside a rotary brush of the floor scrubber, the skirt mechanism comprising:

a mount for coupling to a floor scrubber;

a first arm rotatably connected to the mount, the first arm having a lever;

a second arm rotatably connected to the mount;

a blade support rotatably connected to the first and second arms; and a latch connecting the mount and the blade support, the latch including a slot configured to hold the blade support relative to the mount in raised and lowered positions;

wherein the slot is shaped such that the lever can be depressed to both raise and lower the blade support to the raised and lowered positions.

2. The skirt mechanism of claim 1, wherein the slot comprises:

an elongate channel extending along an axis;

a V-shaped notch located at an end of the elongate channel, the V-shaped notch being offset relative to the axis; and a notch disposed opposite the V-notch at the end of the elongate channel.

3. The skirt mechanism of claim 2, wherein the latch is pinned to the blade mount at the slot.

4. The skirt mechanism of claim 3, wherein:

an angle between a bottom angled surface of the V-notch and a plane extending between a pin pinning the blade mount at the slot and a pin connecting the latch to the blade support is in the range of approximately 51 degrees to approximately 71 degrees in the raised position.

5. The skirt mechanism of claim 1, wherein the first arm comprises:

a first portion having through-holes for receiving fasteners to connect the first arm to the mount and the blade support; and a jog portion for offsetting the lever from the first portion.

6. The skirt mechanism of claim 1, wherein the lever includes corrugations.

7. The skirt mechanism of claim 1, further comprising:

a clip pinned to the blade mount at a notched channel;

a first spring connecting the first arm to the clip to cause rotation of the first arm; and a second spring connecting the second arm to the blade mount to cause rotation of the second arm.

8. The skirt mechanism of claim 7, wherein the notched channel is shaped to allow the clip to remain in first and second positions relative to the blade mount wherein distances between the clip and the first arm are different in the first and second positions to adjust tension in the first spring.

9. The skirt mechanism of claim 8, wherein the notched channel comprises:

an elongate channel extending along an axis; and an arcuate notch located at an end of the elongate channel.

10. The skirt mechanism of claim 7, wherein the clip includes a finger tab.

11. The skirt mechanism of claim 7, further comprising a rod connecting the first arm and the second arm.

12. A scrubber machine comprising:

a chassis;

a set of wheels connected to the chassis;

a motor mounted on the chassis to provide propulsion to the scrubber machine;

a brush scrubbing system mounted to the chassis to provide scrubbing; and a skirt mechanism mounted to the chassis, the skirt mechanism comprising:

a mount for coupling to a floor scrubber;

a first arm rotatably connected to the mount, the first arm having a lever;

a second arm rotatably connected to the mount;

a blade support rotatably connected to the first and second arms; and a latch connecting the mount and the blade support, the latch including a slot configured to hold the blade support relative to the mount in raised and lowered positions;

wherein the slot is shaped such that the lever can be depressed to both raise and lower the blade support to the raised and lowered positions.

13. The scrubber machine of claim 12, wherein the slot comprises:

an elongate channel extending along an axis;

a V-shaped notch located at an end of the elongate channel, the V-shaped notch being offset relative to the axis; and a notch disposed opposite the V-notch at the end of the elongate channel.

14. The scrubber machine of claim 13, wherein the latch is pinned to the blade mount at the slot.

15. The scrubber machine of claim 14, wherein:

an angle between a bottom angled surface of the V-notch and a plane extending between a pin pinning the blade mount at the slot and a pin connecting the latch to the blade support is in the range of approximately 51 degrees to approximately 71 degrees in the raised position.

16. The scrubber machine of claim 15, wherein the first arm comprises:

a first portion having through-holes for receiving fasteners to connect the first arm to the mount and the blade support; and a jog portion for offsetting the lever from the first portion.

17. The scrubber machine of claim 12, wherein the skirt mechanism further comprises:

a clip pinned to the blade mount at a notched channel;

a first spring connecting the first arm to the clip to cause rotation of the first arm; and a second spring connecting the second arm to the blade mount to cause rotation of the second arm.

18. The scrubber machine of claim 17, wherein the notched channel is shaped to allow the clip to remain in first and second positions relative to the blade mount wherein distances between the clip and the first arm are different in the first and second positions to adjust tension in the first spring.

19. The scrubber machine of claim 18, wherein the notched channel comprises:

an elongate channel extending along an axis; and an arcuate notch located at an end of the elongate channel.

20. The scrubber machine of claim 17, wherein the skirt mechanism further comprises a rod connecting the first arm and the second arm.

* * * * *